US010458232B2

(12) United States Patent
Villareal et al.

(10) Patent No.: US 10,458,232 B2
(45) Date of Patent: Oct. 29, 2019

(54) FORMATION FLUID SAMPLE CONTAINER APPARATUS

(71) Applicant: Schlumberger Technology Corporation, Sugar Land, TX (US)

(72) Inventors: Steven G. Villareal, Stonehouse (GB); Kent David Harms, Richmond, TX (US); Jeremy Murphy, Sugar Land, TX (US); Julian Pop, Houston, TX (US); Dale Meek, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 95 days.

(21) Appl. No.: 15/250,369

(22) Filed: Aug. 29, 2016

(65) Prior Publication Data

US 2016/0369628 A1 Dec. 22, 2016

Related U.S. Application Data

(63) Continuation of application No. 13/246,499, filed on Sep. 27, 2011, now Pat. No. 9,429,014.

(60) Provisional application No. 61/387,648, filed on Sep. 29, 2010.

(51) Int. Cl.

| | |
|---|---|
| ***E21B 49/08*** | (2006.01) |
| ***E21B 27/00*** | (2006.01) |
| ***E21B 49/10*** | (2006.01) |

(52) U.S. Cl.

CPC ..... *E21B 49/081* (2013.01); *E21B 27/00* (2013.01); *E21B 49/086* (2013.01); *E21B 49/10* (2013.01)

(58) Field of Classification Search

CPC ..... E21B 27/00; E21B 49/081; E21B 49/086; E21B 49/10

See application file for complete search history.

(56) References Cited

U.S. PATENT DOCUMENTS

| | | | |
|---|---|---|---|
| 3,011,554 | A | 12/1961 | Robert et al. |
| 3,289,474 | A | 12/1966 | Smith et al. |
| 3,437,138 | A | 4/1969 | Scott et al. |

(Continued)

FOREIGN PATENT DOCUMENTS

| | | | |
|---|---|---|---|
| EP | 1788188 | A1 | 5/2007 |
| SU | 883381 | A1 | 11/1981 |

(Continued)

OTHER PUBLICATIONS

International Search Report and Written Opinion issued in PCT/US2011/053673 dated Jan. 30, 2013, 7 pages.

(Continued)

*Primary Examiner* — Caroline N Butcher

(57) ABSTRACT

Formation fluid sample container apparatus are described. An example apparatus includes a downhole tool having a body including an opening and a cavity extending into the body from the opening. The sample container includes an elongated container for holding a formation fluid sample and a sheath coupled to an outer surface of the elongated container and at least partially surrounding the elongated container. The sample container is fixed in the cavity and the sheath is to increase the mechanical integrity of the elongated container in a downhole environment.

16 Claims, 20 Drawing Sheets

(56) References Cited

U.S. PATENT DOCUMENTS

| | | | |
|---|---|---|---|
| 3,611,799 | A | 10/1971 | Davis et al. |
| 3,859,851 | A | 1/1975 | Urbanosky |
| 3,894,780 | A | 7/1975 | Broussard |
| 4,416,152 | A | 11/1983 | Wilson |
| 4,507,957 | A | 4/1985 | Montgomery et al. |
| 4,583,595 | A | 4/1986 | Czemichow et al. |
| 4,616,152 | A | 10/1986 | Saito et al. |
| 4,750,570 | A | 6/1988 | Barrett |
| 4,856,585 | A | 8/1989 | White et al. |
| 4,860,581 | A | 8/1989 | Zimmerman et al. |
| 4,936,139 | A | 6/1990 | Zimmerman et al. |
| 5,036,916 | A | 8/1991 | Bennett |
| 5,233,866 | A | 8/1993 | Desbrandes |
| 5,240,072 | A | 8/1993 | Schultz et al. |
| 5,303,775 | A | 4/1994 | Michaels et al. |
| 5,337,822 | A | 8/1994 | Massie et al. |
| 5,361,839 | A | 11/1994 | Griffith et al. |
| 5,540,280 | A | 7/1996 | Schultz et al. |
| 5,609,205 | A | 3/1997 | Massie et al. |
| 5,704,425 | A | 1/1998 | Divis et al. |
| 5,743,343 | A | 4/1998 | Heller et al. |
| 5,803,186 | A | 9/1998 | Berger et al. |
| 5,826,662 | A | 10/1998 | Beck et al. |
| 6,006,834 | A | 12/1999 | Skinner |
| 6,216,782 | B1 | 4/2001 | Skinner |
| 6,230,557 | B1 | 5/2001 | Ciglenec et al. |
| 6,301,959 | B1 | 10/2001 | Hrametz et al. |
| 6,439,307 | B1 | 8/2002 | Reinhardt |
| 6,467,544 | B1 | 10/2002 | Brown et al. |
| 6,585,045 | B2 | 7/2003 | Lee et al. |
| 6,609,568 | B2 | 8/2003 | Krueger et al. |
| 6,659,177 | B2 | 12/2003 | Bolze et al. |
| 6,688,390 | B2 | 2/2004 | Bolze et al. |
| 6,719,049 | B2 | 4/2004 | Sherwood et al. |
| 6,837,314 | B2 | 1/2005 | Krueger et al. |
| 6,964,301 | B2 | 11/2005 | Hill et al. |
| 6,986,282 | B2 | 1/2006 | Ciglenec et al. |
| 7,114,562 | B2 | 10/2006 | Fisseler et al. |
| 7,124,819 | B2 | 10/2006 | Ciglenec et al. |
| 7,198,105 | B2 | 4/2007 | Grant et al. |
| 7,367,394 | B2 | 5/2008 | Villareal et al. |
| 7,543,659 | B2 | 6/2009 | Partouche et al. |
| 7,546,885 | B2 | 6/2009 | Longfield |
| 7,594,541 | B2 | 9/2009 | Ciglenec et al. |
| 7,600,420 | B2 | 10/2009 | Meek |
| 7,841,406 | B2 | 11/2010 | Zazovsky et al. |
| 7,845,405 | B2 | 12/2010 | Villareal et al. |
| 8,235,106 | B2 | 8/2012 | Fox et al. |
| 8,301,959 | B2 | 10/2012 | Chung |
| 9,314,295 | B2 | 4/2016 | Garrison |
| 2002/0060067 | A1 | 5/2002 | Bolze et al. |
| 2003/0033866 | A1 | 2/2003 | Diakonov et al. |
| 2003/0066646 | A1 | 4/2003 | Shammai et al. |
| 2003/0098156 | A1 | 5/2003 | Follini et al. |
| 2003/0221824 | A1 | 12/2003 | Solfronk et al. |
| 2004/0000433 | A1 | 1/2004 | Hill et al. |
| 2004/0007058 | A1 | 1/2004 | Rylander et al. |
| 2004/0011525 | A1 | 1/2004 | Jones et al. |
| 2004/0026125 | A1 | 2/2004 | Meister et al. |
| 2004/0035199 | A1 | 2/2004 | Meister et al. |
| 2004/0083805 | A1 | 5/2004 | Ramakrishnan et al. |
| 2004/0089448 | A1 | 5/2004 | DiFoggio |
| 2004/0106524 | A1 | 6/2004 | Jones et al. |
| 2004/0160858 | A1 | 8/2004 | Ciglenec et al. |
| 2004/0163803 | A1 | 8/2004 | Ringgenberg et al. |
| 2004/0163808 | A1 | 8/2004 | Ringgenberg et al. |
| 2004/0195007 | A1 | 10/2004 | Eppink |
| 2004/0216521 | A1 | 11/2004 | Shammai et al. |
| 2004/0216874 | A1 | 11/2004 | Grant et al. |
| 2004/0231841 | A1 | 11/2004 | Niemeyer et al. |
| 2004/0231842 | A1 | 11/2004 | Shammai et al. |
| 2004/0244971 | A1 | 12/2004 | Shammai et al. |
| 2004/0245016 | A1 | 12/2004 | Chemali et al. |
| 2004/0256161 | A1 | 12/2004 | Aronstam et al. |
| 2005/0001624 | A1 | 1/2005 | Ritter et al. |
| 2005/0011644 | A1 | 1/2005 | Krueger et al. |
| 2005/0028973 | A1 | 2/2005 | Paluch et al. |
| 2005/0028974 | A1 | 2/2005 | Moody |
| 2005/0039527 | A1 | 2/2005 | Dhruva et al. |
| 2005/0072565 | A1 | 4/2005 | Segura et al. |
| 2005/0086699 | A1 | 4/2005 | Hahn et al. |
| 2005/0109538 | A1 | 5/2005 | Fisseler et al. |
| 2005/0115716 | A1 | 6/2005 | Ciglenec et al. |
| 2005/0150287 | A1 | 7/2005 | Carnegie et al. |
| 2005/0150688 | A1 | 7/2005 | MacGregor et al. |
| 2005/0205302 | A1 | 9/2005 | Meister et al. |
| 2005/0235745 | A1 | 10/2005 | Proett et al. |
| 2005/0246151 | A1 | 11/2005 | DiFoggio |
| 2007/0119587 | A1 | 5/2007 | Shammai et al. |
| 2007/0137896 | A1* | 6/2007 | Villareal ..... E21B 17/16 175/59 |
| 2008/0041593 | A1 | 2/2008 | Brown et al. |
| 2008/0245570 | A1 | 10/2008 | Partouche |
| 2009/0126996 | A1 | 5/2009 | Villareal et al. |

FOREIGN PATENT DOCUMENTS

| | | | |
|---|---|---|---|
| WO | WO9314295 | A1 | 7/1993 |
| WO | WO0163093 | A1 | 8/2001 |
| WO | WO03025326 | A2 | 3/2003 |
| WO | WO2011102840 | A1 | 8/2011 |

OTHER PUBLICATIONS

International Preliminary Report on Patentability issued in PCT/US2011/053673 dated Apr. 1, 2014, 5 pages.

* cited by examiner

FORMATION FLUID SAMPLE CONTAINER APPARATUS

RELATED APPLICATION

This application is a continuation of co-pending U.S. patent application Ser. No. 13/246,499, filed Sep. 27, 2011, which claims the benefit of, and priority to, the filing date of U.S. Provisional Patent Application No. 61/387,648, filed on Sep. 29, 2010, the entire disclosures of which are incorporated by reference herein.

BACKGROUND OF THE DISCLOSURE

To sample and test fluids such as deposits of hydrocarbons and other desirable materials trapped in underground formations, a wellbore is drilled by connecting a drill bit to the lower end of a series of coupled sections of tubular pipe known as a drillstring. A downhole sampling tool may be deployed in the wellbore drilled through the formations. The downhole sampling tool may include a fluid communication device, such as a probe or a straddle packer to establish fluid communication between the downhole sampling tool and a formation penetrated by the wellbore.

Fluid samples may be extracted from the formation via the fluid communication device using a fluid pump provided with the downhole sampling tool. Various downhole sampling tools for wireline and/or while-drilling applications are known in the art such as those described in U.S. Pat. Nos. 6,964,301, 7,543,659, 7,594,541, and 7,600,420. The entireties of these patents are hereby incorporated herein.

Sampling tools may be provided with a plurality of sample bottles to receive and retain the fluid samples. Sample bottles include, for example, those described in U.S. Pat. Nos. 6,467,544, 7,367,394, and 7,546,885, the entireties of which are incorporated herein by reference.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
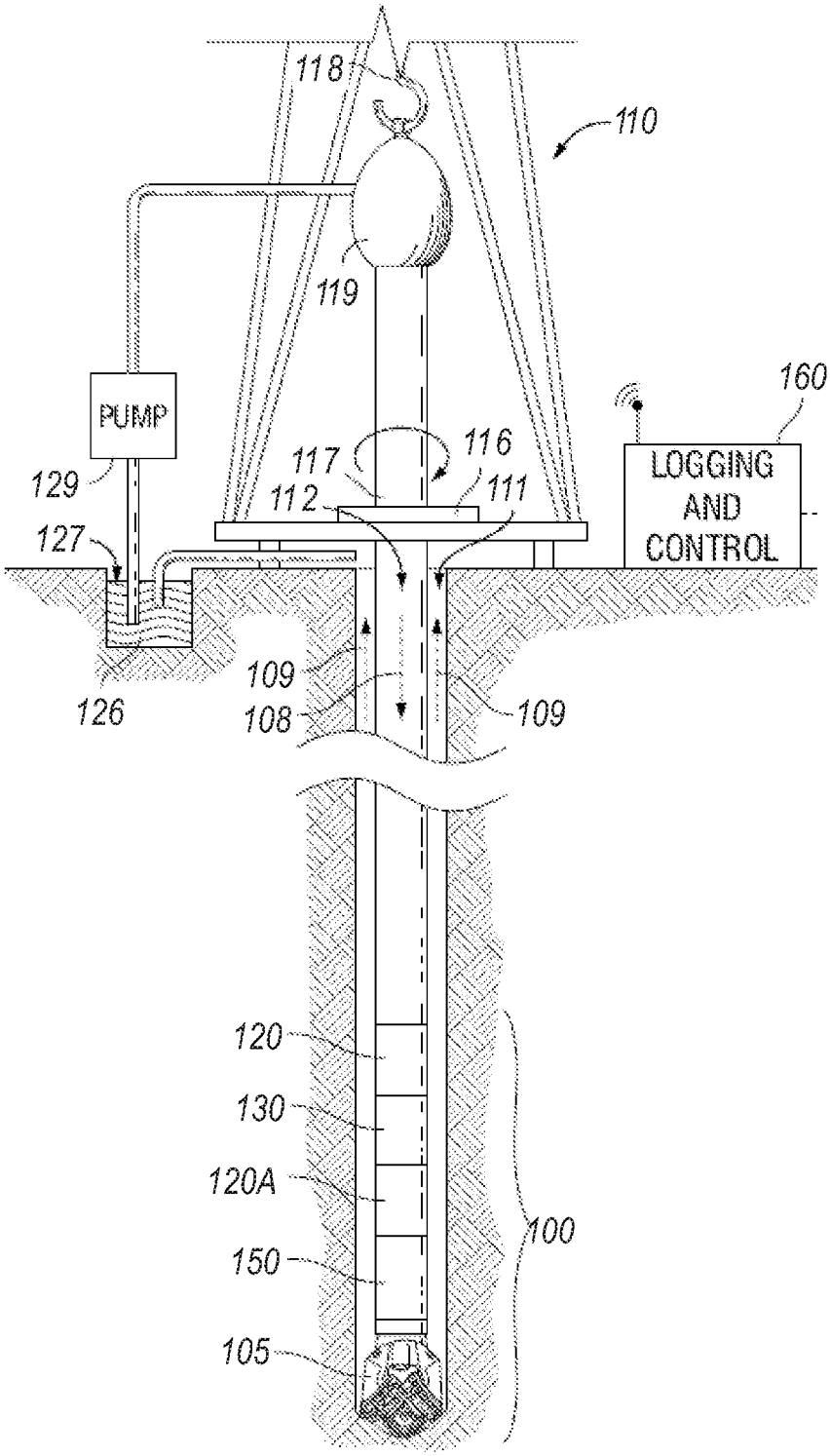
FIGS. 1 to 27 are schematic views of apparatus according to one or more aspects of the present disclosure.

It is to be understood that the following disclosure provides many different embodiments or examples for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact and may also include embodiments in which additional features may be formed interposing the first and second features such that the first and second features may not be in direct contact.

In one or more aspects, the present disclosure describes apparatus that may facilitate incorporating variable number of sample bottles to a downhole sampling tool, for example a sampling-while-drilling (SWD) tool. In some examples, the downhole sampling tool is to capture samples of formation fluid into relatively few sample bottles. In other examples, the downhole sampling tool is to capture samples of formation fluid into a relatively large number of sample bottles. Therefore, it may be useful to variably extend the string of sample bottles incorporated to a downhole sampling tool.

In one or more aspects, the present disclosure describes apparatus that may facilitate securing sample bottles to a downhole sampling tool, for example an SWD tool. Once sample bottles have been incorporated to the downhole sampling tool at the Earth's surface, the downhole sampling tool is lowered into a wellbore penetrating subterranean formations. The downhole sampling tool may be used to collect samples of formation fluid into one or more of the sample bottles. In some examples, the wellbore is further extended through subterranean formations prior to and/or after collecting fluid samples. Therefore, it may be useful to secure the sample bottles in a way that is likely to endure the harsh environment encountered during drilling and/or tripping.

In one or more aspects, the present disclosure describes apparatus that may facilitate handling formation fluid samples retained in sample bottles of a downhole sampling tool, for example an SWD tool. Once the downhole sampling tool has been retrieved to the Earth's surface, the fluid samples retained in the sample bottles may be positively sealed within the sample bottles using, for example, a manually activated valve. The sample bottles may then be detached or removed from at least a portion of the downhole sampling tool to, for example, be transported to a remote laboratory where the fluid samples retained in the sample bottles may be analyzed. The fluid samples retained in the sample bottles may alternatively be transferred to another container, vessel or analyzer chamber while the sample bottles are still incorporated to the downhole sampling tool. In that case, access to the sample bottles may be provided while the sample bottles are still incorporated to the sampling tool to, for example, positively seal and/or transfer the retained fluid samples, among other purposes. Alternatively or additionally, the sample bottles may be provided with self-closing devices that are actuated upon detaching or removing the sample bottles from a downhole sampling tool.

FIG. 1 is a schematic view of a well site according to one or more aspects of the present disclosure. The well site may be situated onshore (as shown) or offshore. The well site includes platform and derrick assembly 110 positioned over a wellbore 111. The platform and derrick assembly 110 is to extend the wellbore 111 through subterranean formations.

The platform and derrick assembly 110 is to suspend a drill string 112 within the wellbore 111. For example, the assembly 110 includes a rotary table 116, a kelly 117, a hook 118 and a rotary swivel 119. The hook 118 is attached to a traveling block (not shown) of the platform and derrick assembly 110. The drill string 112 is suspended from the hook 118 through the kelly 117 and the rotary swivel 119. Rotation of the drill string 112 relative to the hook 118 is permitted through the rotary swivel 119. The drill string 112 may be rotated by the rotary table 116, which is itself operated by well known means not shown. The rotary table 116 engages the kelly 117 at the upper end of the drill string 112. As is well known, a top drive system may alternatively be used instead of the kelly 117 and the rotary table 116 to rotate the drill string 112 from the surface.

The wellbore 111 may be extended through subsurface formations using the platform and derrick assembly 110 and the drill string 112. The drill string 112 includes a bottom hole assembly (BHA) 100 proximate the lower end thereof. The BHA 100 includes a drill bit 105 at its lower end powered by a hydraulically operated motor 150. The platform and derrick assembly 110 further includes drilling fluid or mud 126 stored in a tank or pit 127 formed at the well site. Drilling fluids or mud may be pumped down through a central bore of the drill string 112 and exit through ports located at the drill bit 105. The drilling fluids act to lubricate and cool the drill bit 105, to carry cuttings back to the surface, and to establish sufficient hydrostatic head to prevent formation fluids from blowing out the wellbore 111 once they are reached. A pump 129 delivers the drilling fluid 126 to an interior passage of the drill string 112 via a port in the swivel 119, thereby causing the drilling fluid 126 to flow downwardly through the drill string 112 as indicated by the directional arrow 108. The drilling fluid 126 actuates the motor 150, which rotates the bit 105. The drilling fluid 126 exits the drill string 112 via water courses, or nozzles (jets) in the drill bit 105, and then circulates upwardly through the annulus region between the outside of the drill string and the wall of the wellbore 111 as indicated by the directional arrows 109. In this well-known manner, the drilling fluid 126 lubricates the drill bit 105 and carries formation cuttings up to the surface, where the drilling fluid 126 may be cleaned and returned to the pit 127 for recirculation.

The BHA 100 is to acquire and transmit information about the trajectory of the wellbore 111. For example, the BHA 100 includes a measuring-while-drilling (MWD) tool 130. The MWD tool 130 may be housed in a special type of drill collar, as is known in the art, and may contain one or more devices for measuring characteristics of the drill string 112 and the drill bit 105. For example, the MWD tool 130 may include one or more of the following types of measuring devices: a weight-on-bit measuring device, a torque measuring device, a vibration measuring device, a shock measuring device, a stick slip measuring device, a direction measuring device, and an inclination measuring device. Optionally, the MWD tool 130 may further comprise an annular pressure sensor and/or a natural gamma ray sensor. The MWD tool 130 may also include capabilities for measuring, processing, and storing information, as well as for communicating with a logging and control unit 160. For example, the MWD tool 130 and the logging and control unit 160 may communicate information in two directions (i.e., uphole via uplinks and/or downhole via downlinks) using systems sometimes referred to as mud pulse telemetry (MPT) and/or wired drill pipe (WDP) telemetry. In some cases, the logging and control unit 160 may include a controller having an interface to receive commands from a human operator. The commands may be broadcast to the BHA 100 via the MWD tool 130.

The BHA 100 is also to acquire and optionally transmit information about the subterranean formations penetrated by the wellbore 111. For example, the BHA 100 further includes a sampling-while-drilling (SWD) tool 120 and a logging-while-drilling (LWD) tool 120A. The SWD tool 120 and the LWD tool 120A may also be housed in a special type of drill collar, as is known in the art, and may contain one or a plurality of known types of well logging instruments. For example, the LWD tool 120A comprises one or more of a nuclear magnetic resonance measuring device, a resistivity measuring device, a neutron or gamma-ray measuring device, etc. The SWD tool 120 comprises a fluid communication device (not shown) to extend from the drill string 112 and establish fluid communication with a subterranean formation penetrated by the wellbore 111 in which the drill string 112 is positioned. The SWD tool 120 and the LWD tool 120A may include capabilities for measuring, processing, and storing information, as well as for communicating with the MWD tool 130. It is understood that more than one LWD tool or SWD tool may be employed within the scope of the present disclosure.

Figure 2:
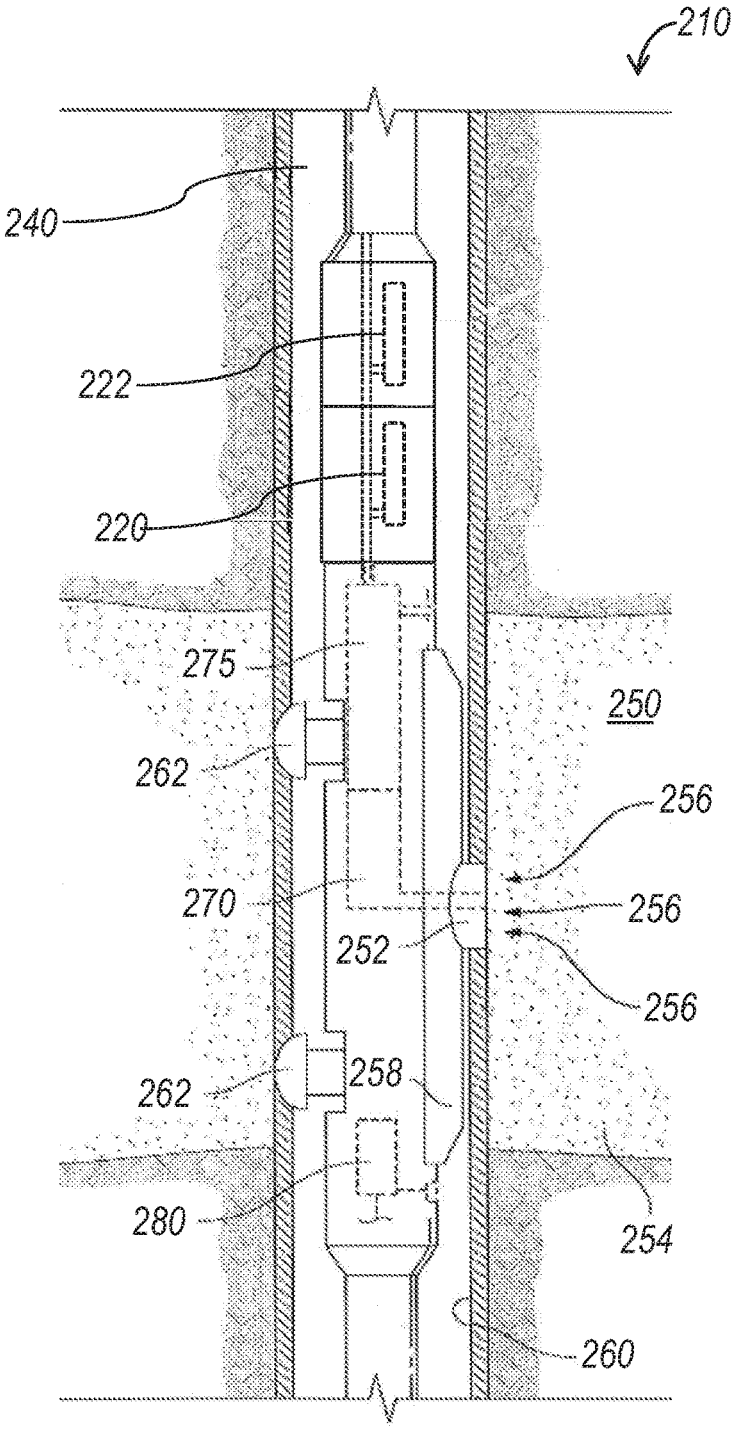

FIG. 2 is a schematic view of a sampling-while-drilling tool 210 according to one or more aspects of the present disclosure. The SWD tool 210 is positioned in a wellbore 240 extending through subterranean formations, such as formation 250. The SWD tool 210 is to acquire samples of formation fluid 254 and retain at least some of the samples in sample bottles 220 and 222.

The SWD tool 210 may be provided with a stabilizer that may include one or more blades 258 to engage a wall 260 of the wellbore 240. The SWD tool 210 may be provided with a plurality of backup pistons 262 to assist in applying a force to push and/or move the SWD tool 210 against the wall 260 of the wellbore 240. A fluid communication device, such as a probe 252, may extend from the stabilizer blade 258 of the SWD tool 210. The fluid communication device may be implemented with a guarded or focused fluid admitting assembly, for example, as shown in U.S. Pat. No. 6,964,301. The fluid communication device is to seal off or isolate selected portions of the wall 260 of the wellbore 240 and to fluidly couple the SWD tool 210 to the adjacent formation 250. While the SWD tool 210 is depicted as having one fluid communication device, a plurality of fluid communication devices may alternatively be provided on the SWD tool 210.

Once the fluid communication device 252 fluidly couples to the formation 250, various measurements may be conducted on the formation 250, for example, a pressure parameter may be measured by performing a pretest in a manner known in the art. Also, a pump 275 may be used to draw the formation fluid 254 from the formation 250 into the SWD tool 210 in a direction generally indicated by arrows 256. The SWD tool 210 includes a fluid sensing unit 270 to measure properties of the fluid samples extracted from the formation 250. The fluid sensing unit 270 may include any combination of conventional and/or future-developed spectral analysis systems.

The fluid drawn from the formation 250 into the SWD tool 210 may be expelled through an exit port into the wellbore 240 or may be sent to one or more of the sample bottles 220 and 222, which receive and retain the formation fluid for subsequent testing at the surface or a testing facility. More or less than two sample bottles may be employed.

The SWD tool 210 comprises a downhole control system 280, which may include a processor or processing unit to execute software commands or instructions stored on a memory and/or any tangible computer readable medium. For example, the downhole control system 280 may control the extraction of fluid samples from the formation 250 by controlling the pumping rate of the pump 275. The downhole control system 280 may also be used to analyze and/or process data obtained, for example, from the fluid sensing unit 270 or other downhole sensors (not shown), store and/or communicate measurement or processed data to the surface for subsequent analysis.

Figure 3:
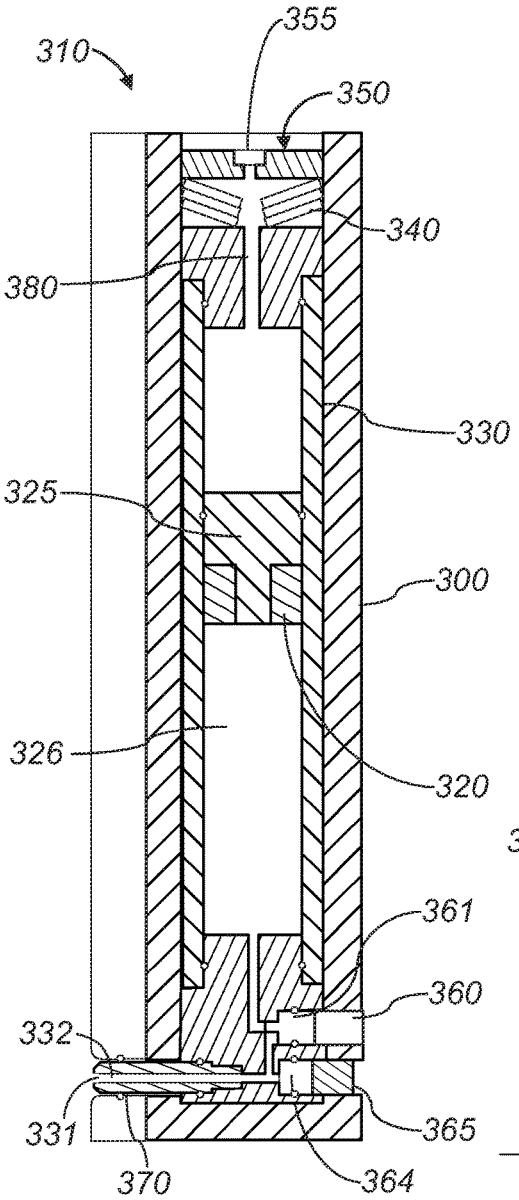
Figure 3A:
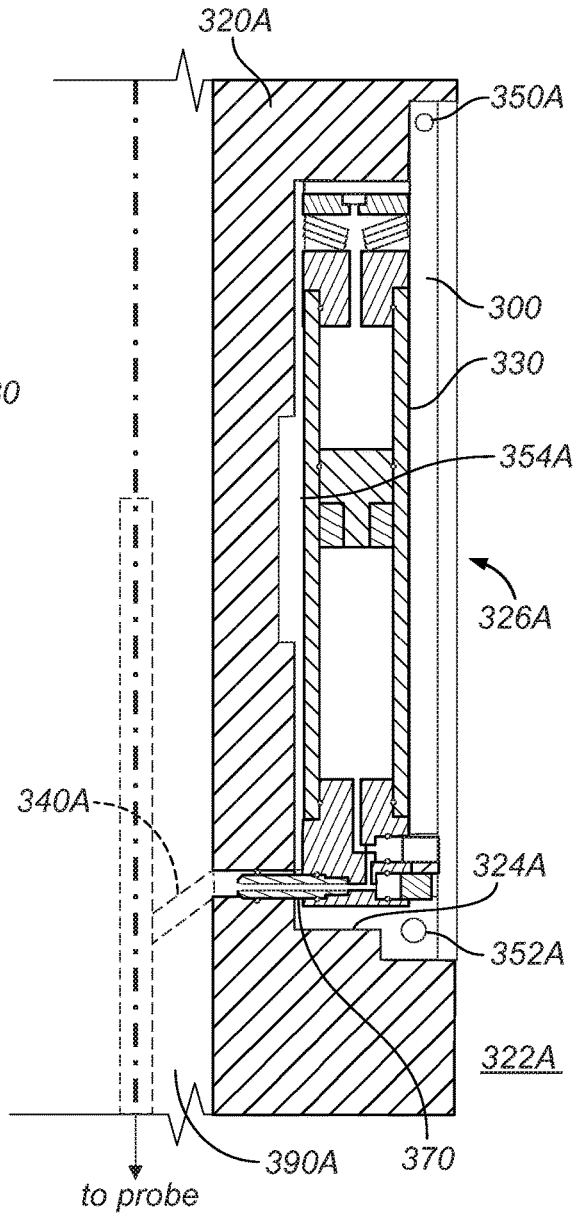

FIGS. 3 and 3A are schematic views of an example sample bottle 310 according to one or more aspects of the present disclosure. The sample bottle 310 is to be incorporated into a downhole sampling tool 320A. The sample bottle 310 may be used to receive and retain samples of formation fluid.

The sample bottle 310 comprises an elongated container 330. The container 330 may be made of corrosion and pressure resistant material such as a nickel based alloy. The container 330 is to receive fluid samples through an inlet 331. As shown, the inlet 331 includes a flowline 332 extending from the container 330 through a stabber 370, which is depicted in this example as right angle stabber. The flowline 332 may be closed via a manual shut-in valve 361, which is accessible via a closable access port 360. Thus, a sample of formation fluid retained in the container 300 may be positively sealed. Also, pressure trapped in the flowline 322, for example after closing the shut-in valve 361, may be released via a vent plug 364, which is also accessible via a closable access port 365.

A sliding piston 325 is disposed within the elongated container 330 defines a variable volume chamber 326 to receive the sample of formation fluid. Optionally, an agitator 320 may be included in the chamber 326. The agitator 320 may be used to mix or recombine the sample of formation fluid present in the chamber 326. The backside of the piston 325 may be exposed to wellbore fluid or other fluid entering the container 330 via a passage 380.

The sample bottle 310 comprises a sleeve or sheath 300, such as cylindrical blind cap, sized to engage an outer surface of the elongated container 330. For example, the elongated container 330 may be inserted into the sleeve or sheath 300 prior to the installation of the stabber 370 and the closing devices of the ports 360 and 365. Additionally, a spring pack 340 may be compressed by screwing a jam nut 350 into the sleeve or sheath 300, thereby maintaining the position of the elongated container 330 inside the sleeve or sheath. The jam nut 350 may optionally be provided with a filter 355 to allow wellbore fluid or other fluid to enter the container 330 via the passage 380.

The sheath 300 is made of scratch and impact resistant material such as stainless steel. For example, the stainless steel may be selected to be electrochemically compatible with the material making the cavity into which the sample bottle 310 is secured. The sheath 300 may contribute to preventing the elongated container 330 from impacting or dragging against the wall of a wellbore 322A in which the downhole sampling tool is positioned and/or against other formation debris present in the wellbore 322A. The sheath 300 may thus assist in maintaining the mechanical integrity of the elongated container 330, for example the capability of the elongated container 330 to hold high pressure fluid samples.

The sample bottle 310 is to couple to a cavity 324A extending from an opening 326A in the body of the downhole sampling tool 320A, such as a collar having a passage 390A to conduct drilling mud. For example, the sample bottle 310 may be inserted into the cavity 324A through the opening 326A. Upon insertion, the elongated container 330 may fluidly couple to a flowline 340A. Thus, the sample bottle 310 may be in selectable fluid communication with a subterranean formation penetrated by the wellbore 322A via a fluid communication device (e.g. a probe). The sample bottle 310 is further secured into the cavity 324A via roll pins 350A and 352A extending through holes in the sheath 300 and in the body of the downhole sampling tool 320A.

Figure 4:
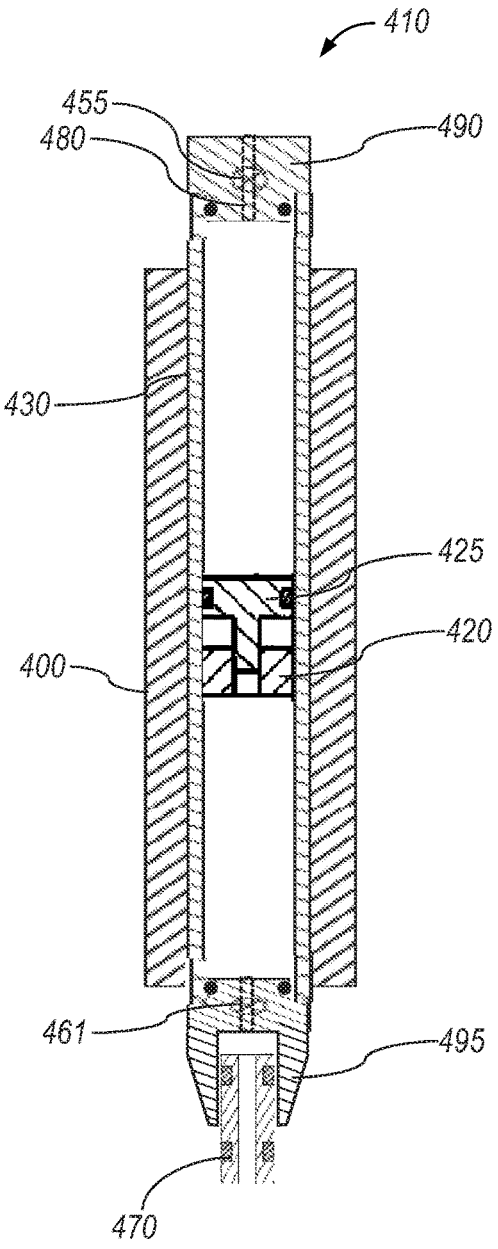
Figure 4A:
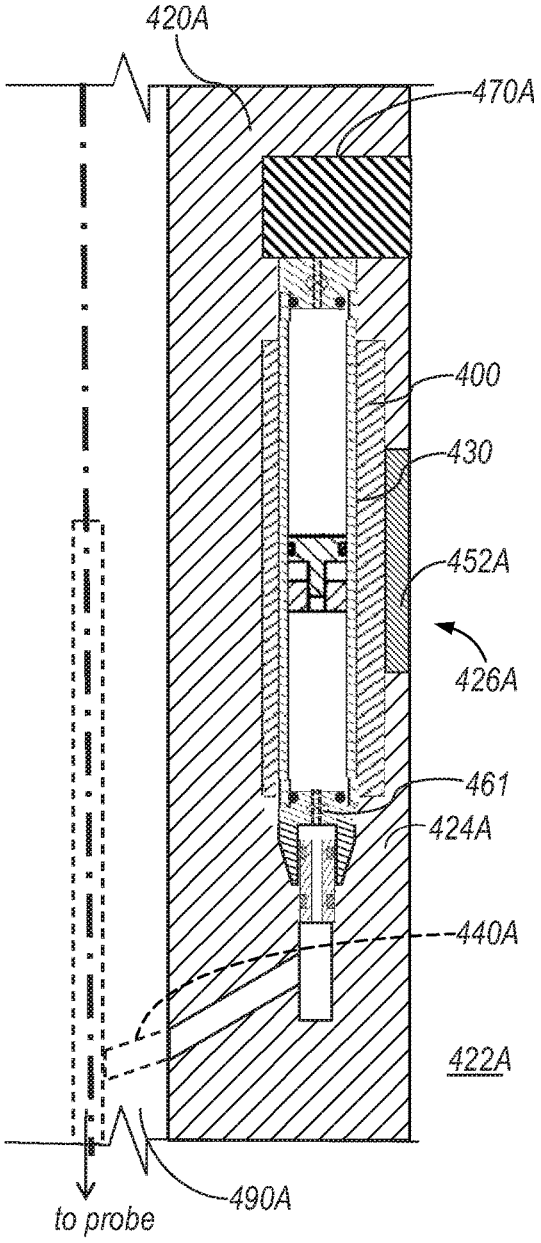

FIGS. 4 and 4A are schematic views of an example sample bottle 410 according to one or more aspects of the present disclosure. The sample bottle 410 is to be incorporated into a downhole sampling tool 420A. The sample bottle 410 may be used to receive and retain samples of formation fluid.

The sample bottle 410 comprises an elongated container 430, an inline stabber 470, and a shut-in valve 461 that may be structurally and/or functionally similar to the elongated container 330, the right angle stabber 370 and the shut-in valve 361 shown in FIG. 3. Further, the sample bottle 410 comprises a piston 425, an agitator 420, and a passage 480 that may also be structurally and/or functionally similar to the piston 325, the agitator 320, and the passage 380 shown in FIG. 3.

The sample bottle 410 comprises a sleeve or sheath 400. The sleeve 400 may be made of polymeric material such as polyether ether-ketone, polyether ketone, fluorocarbon polymer, nitrile butadiene rubber, or epoxy resin. The sleeve 400 may be molded over an outer surface of the elongated container 430. The sleeve may be shrink or slip fitted around the elongated container 430. The sleeve 400 is sized to leave ends 490 and 495 of the sample bottle 410 uncovered to enable access to a manual valve 455 and/or to the shut-in valve 461.

The sample bottle 410 is to couple to a cavity 424A extending from an opening 426A in the body of the downhole sampling tool 420A, such as a collar having a passage 490A to conduct drilling mud. For example, the sample bottle 410 may be inserted into the cavity 424A through the opening 426A. Upon insertion, the elongated container 430 may fluidly couple to a flowline 440A. Thus, the sample bottle 410 may be in selectable fluid communication with a subterranean formation penetrated by a wellbore 422A via a fluid communication device (e.g. a probe).

The sample bottle 410 is further secured in the cavity 424A with a spacer or axial loading device 470A, such as a pneumatic jack or other devices shown in U.S. Pat. No. 7,367,394. In addition, the sheath 400 is sized to snuggly fit into (e.g., via a slight interference fit within) the cavity 424A. Therefore, the sheath 400 may further assist in securing the sample bottle 410 in the cavity 424A. Also, contact between the sheath 400 and the wall of the cavity 424A may permit reducing or attenuating the magnitude of flexural or lateral movements of the elongated container 430 in the cavity 424A. Undesired flexural or lateral movements of the elongated container 430 may be generated, for example, by impacts of the downhole sampling tool 420A against the wall of a wellbore 422A in which the downhole sampling tool is positioned. Reducing the magnitude of the flexural movements of the elongated container 430 may contribute to maintaining the mechanical integrity of the elongated container 430, for example by limiting fatigue and cracking of the elongated container 430. Reducing the magnitude of the flexural movements of the elongated container 430 may also contribute to maintaining the hydraulic integrity of O-rings provided with the stabber 470, among other seals provided with the sample bottle 410.

Figure 5:
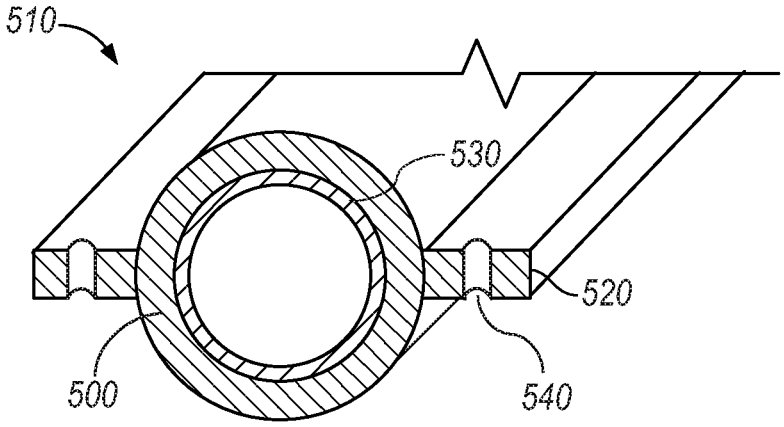
Figure 6:
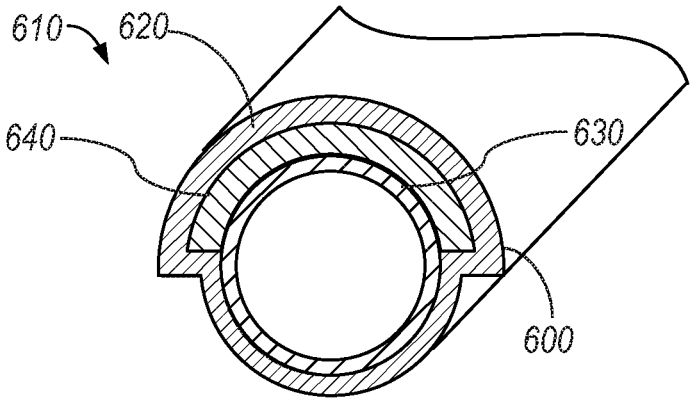
Figure 7:
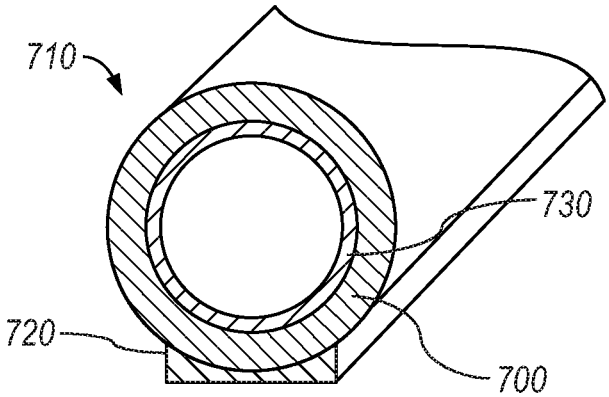

FIGS. 5, 6 and 7 are schematic views of portions of example sample bottles according to one or more aspects of the present disclosure. Sample bottles 510, 610 and 710 include respective elongated container 530, 630 and 730 and respective sheaths 500, 600 and 700. The sheaths 500, 600 and 700 comprise features that may be used alone or in combination.

For example, the sheath 500 comprises flanges or ears 520 protruding away from the center of the sheath. The flanges or ears 520 are to secure the sample bottle 510 to a downhole sampling tool when the sample bottle 510 is coupled to a cavity of the downhole tool. The flanges or ears 520 may include one or more holes 540 positioned and sized to receive a screw therethrough.

In another example, the sheath 600 comprises a layer portion 640 and a cover portion 620 that is affixed to the layer 640. For example, the layer 640 may be made of polymeric material such as polyether ether-ketone, polyether ketone, fluorocarbon polymer, nitrile butadiene rubber or epoxy resin. The cover portion 620 may be made of scratch and impact resistant material, such as stainless steel. The stainless steel may be selected to be electrochemically compatible with the material making the cavity into which the sample bottle 610 is secured. The cover portion 620 may be positioned over a portion of the opening from which the cavity extends.

In yet another example, the sheath 700 comprises a boss 720. The boss 720 may be to engage a corresponding recess in the cavity into which the sample bottle 710 is secured. Referring back to FIG. 3A, a boss 354A similar to the boss 720 is shown. The boss 354A may assist in taking the mechanical load off the right angle stabber 370. Taking the mechanical load off the right angle stabber 370 may contribute to maintaining the hydraulic integrity of O-rings provided with the stabber 370, among other seals provided with the sample bottle 310.

Figure 8:
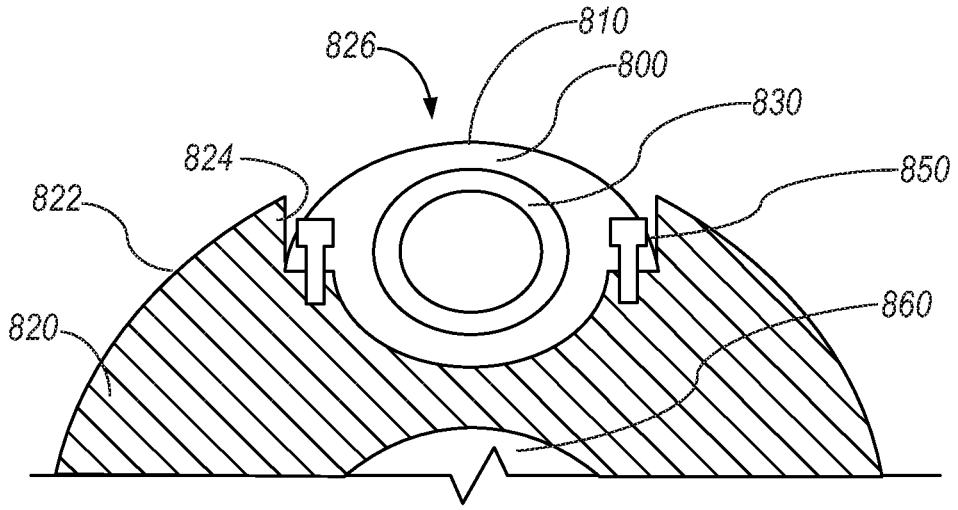
Figure 9:
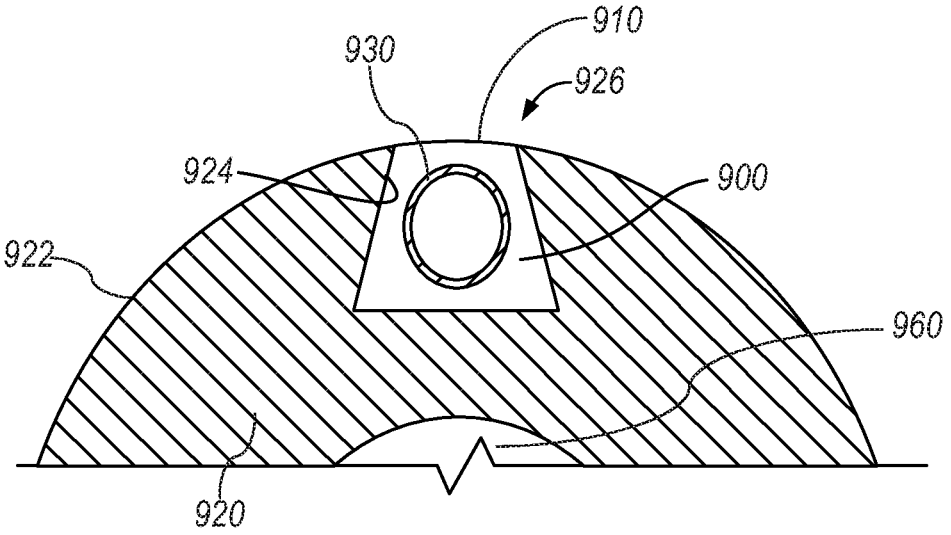

FIGS. 8 and 9 are schematic views of portions of example sampling tools according to one or more aspects of the present disclosure. Each sampling tool comprises a body 820 or 920 (e.g., a collar, a mandrel holder, a housing) having an outer surface, respectively outer surface 822 or 922. The outer surfaces 822 and 922 comprise openings 826 and 926 extending into cavities 824 and 924 in the bodies 820 and 920, respectively. The sampling tools also comprise sample bottles 810 and 910 to receive and retain fluid samples extracted from a subterranean formation penetrated by a wellbore in which the downhole sampling tool is positioned. For example, the sample bottles 810 and 910 may be in selective fluid communication with the subterranean formation via a fluid communication device (not shown) of the sampling tool. In some cases, the sampling tools may also include a passage to conduct drilling mud such as shown with passages 860 and 960.

The sample bottles 810 and 910 comprise respective sheaths, 800 or 900 engaging outer surfaces of elongated containers 830 or 930, respectively. The sheaths 800 and 900 are to couple to the cavities 824 and 924, respectively. For example, the sheath 800 is secured to the body 820 using one or more screws 850. In another example, the sheath 900 comprises a wedged cross section to slide into a dovetail section of the cavity 924. Optionally the sheaths 800 or 900 may include a cover (not shown) affixed thereto. The cover may be positioned over at least a portion of the opening 826 or 926.

Figure 10:
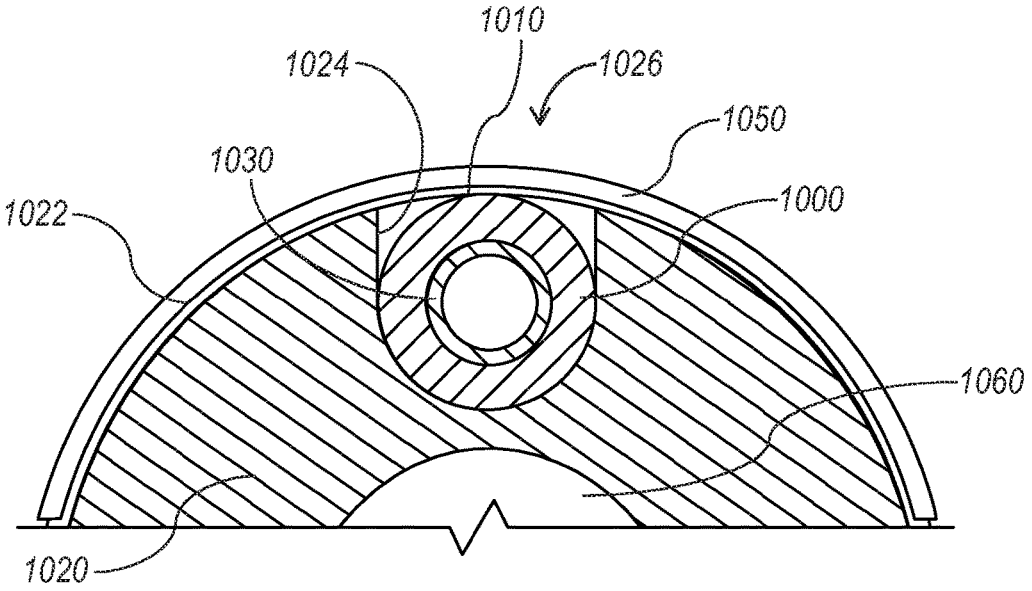

FIG. 10 is a schematic view of a portion of an example sampling tool according to one or more aspects of the present disclosure. Similar to FIG. 2, the sampling tool of FIG. 10 comprises a fluid communication device to extend from the sampling tool and establish fluid communication with a subterranean formation penetrated by a wellbore in which the sampling tool is positioned.

The sampling tool comprises a body 1020 (e.g., a collar, a mandrel holder, a housing) having an outer surface 1022. The outer surface 1022 comprises an opening 1026 extending into a cavity 1024 in the body 1020 of the sampling tool. The sampling tool also comprises a sample bottle 1010 coupled within the cavity 1024 and in selectable fluid communication with the formation via the fluid communication device. The sampling tool may also include a passage to conduct drilling mud, for example as shown with passage 1060.

A ring 1050 is to engage a perimeter of the body 1020 of the sampling tool, for example a cylindrical portion of the outer surface 1022. Also, the ring 1050 is to engage an outer surface of the sample bottle 1010. Thus, the ring 1050 may contribute to securing the sample bottle 1010 within the cavity 1024. Also, the contact between the sample bottle 1010 and the ring 1050 may permit reducing or attenuating the magnitude of flexural or lateral movements of the sample bottle 1010 in the cavity 1024. The ring 1050 may comprise, for example, a wear band or a drill string stabilizer positionable over at least a portion of the cavity 1024.

The opening 1026 into the cavity 1024 and the ring 1050 may provide access to components of the sample bottle 1010. Referring back to FIG. 4A, a ring 452A similar to the ring 1050 is shown. The cavity 424A and the ring 452A are to permit access to the shut-in valve 461. The shut-in valve 461 is to positively seal the fluid samples retained in the sample bottle 410, for example by manually closing the valve 461 once the downhole sampling tool has been retrieved to the Earth's surface. The sample bottle 410 may then be safely detached or removed from the cavity 424A.

Returning to FIG. 10, the sample bottle 1010 may comprise an inner metallic container 1030 to hold pressurized formation fluid and an outer polymeric sheath 1000. However, other material combinations may be used within the scope of the present disclosure.

Figure 11:
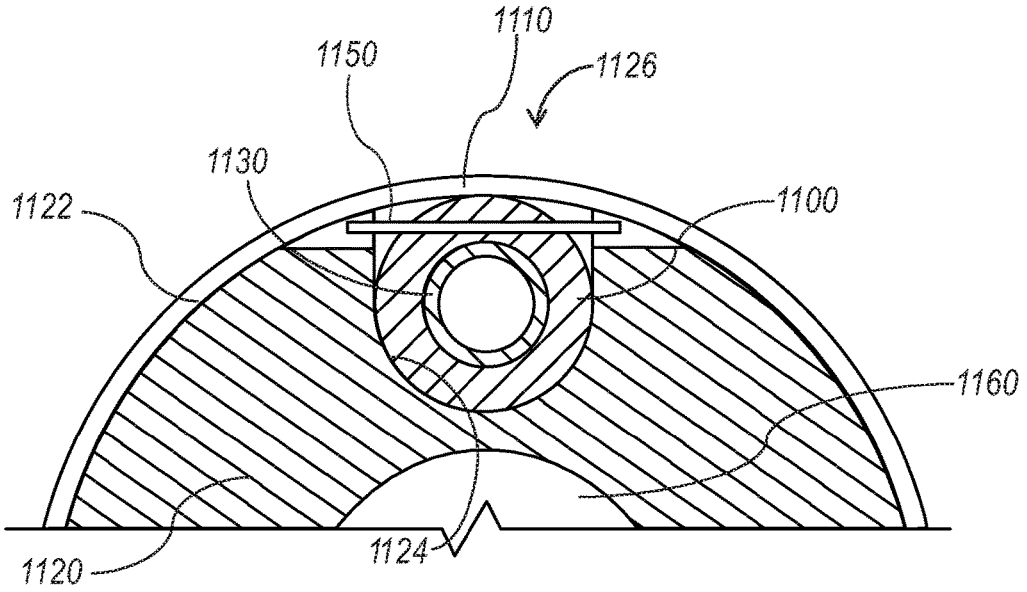
Figure 12:
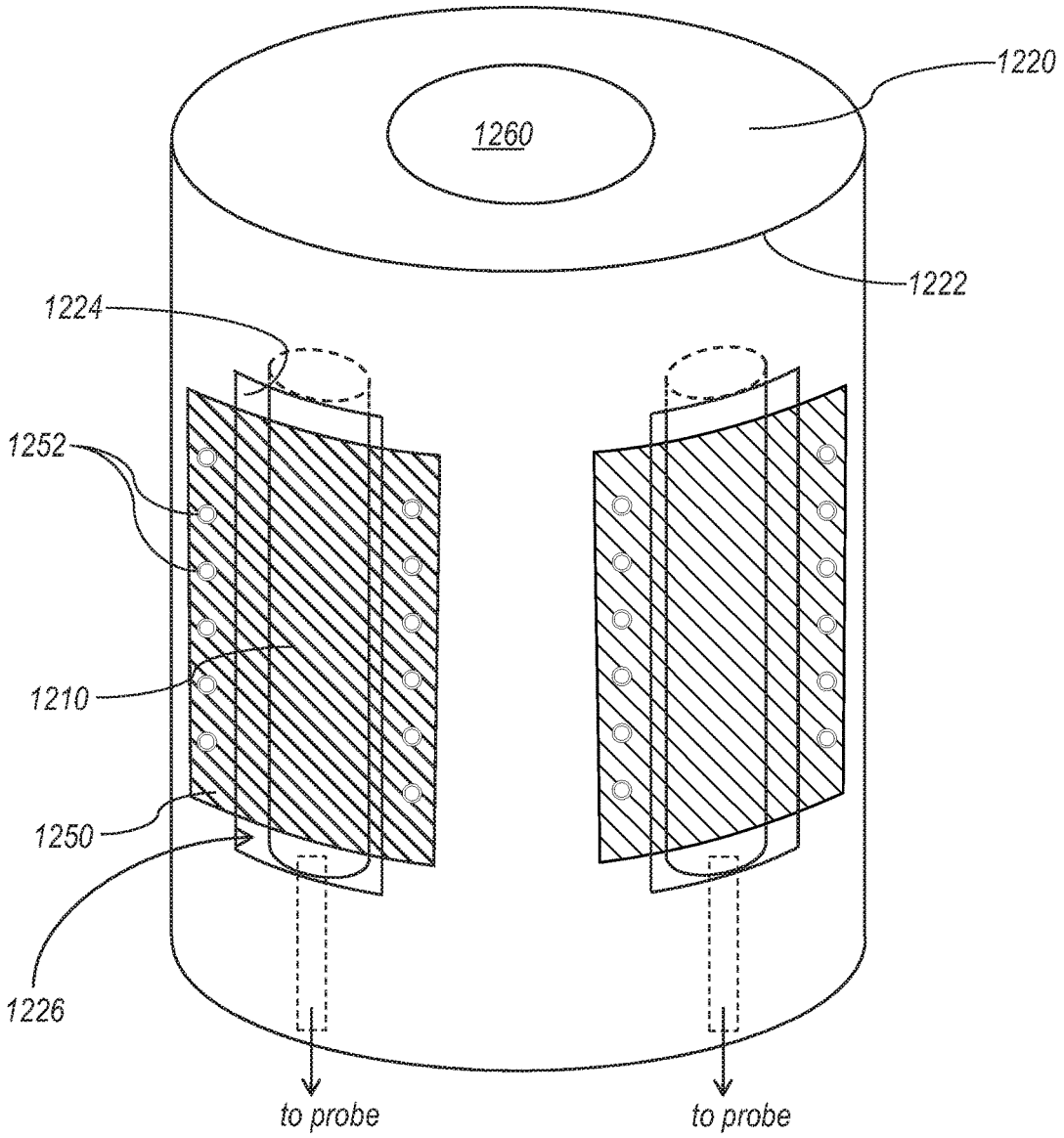
Figure 13:
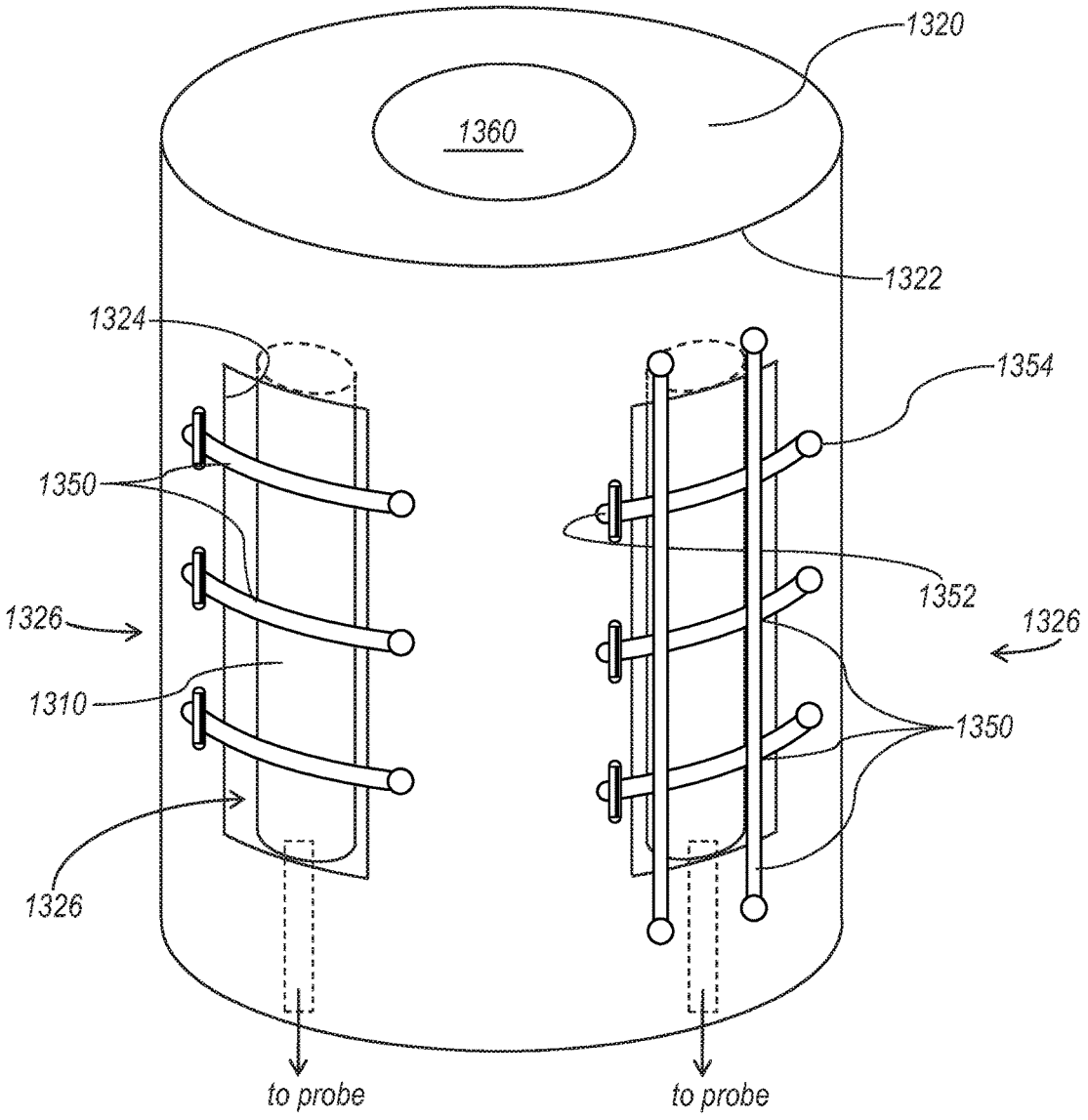

FIGS. 11, 12 and 13 are schematic views of portions of example sampling tools according to one or more aspects of the present disclosure. Similar to FIG. 2, the sampling tools comprise one or more fluid communication devices (e.g., probes) to extend from the sampling tools and to establish fluid communication with a subterranean formation penetrated by a wellbore in which any of the sampling tools are positioned.

Each sampling tool comprises a body 1120, 1220 or 1320 (e.g., a collar, a mandrel holder, a housing) having an outer surface, respectively outer surface 1122, 1222 or 1322. The outer surfaces 1122, 1222 and 1322 comprise openings 1126, 1226 and 1326 extending into cavities 1124, 1224, and 1324 in the bodies 1120, 1220 and 1320, respectively. The sampling tools also comprise sample bottles 1110, 1210 and 1310 to receive and retain fluid samples extracted from a subterranean formation. For example, the sample bottles 1110, 1210 and 1310 may be in selective fluid communication with the subterranean formation via a fluid communication device (not shown) of the sampling tools. In some cases, the sampling tools may also include a passage to conduct drilling mud, as shown with passages 1160, 1260 and 1360.

Each sample bottle 1110, 1210 or 1310 is secured in a cavity, respectively the cavity 1124, 1224 or 1324, with braces. The braces are removably coupled to the outer surface (1122, 1222 or 1322) of the sampling tool at opposing sides of the cavity. The braces may relieve some of the load generated by the pressure of the fluid inside the sample bottle. The braces may alternatively or additionally permit reducing or attenuating the magnitude of flexural or lateral movements of the sample bottle in the cavity when such movements are generated, for example, during drilling of a wellbore.

For example, the braces may include one or more roll pins, such as the roll pin 1150 shown in FIG. 11. The roll pin is inserted into a hole provided in the sample bottle 1110. The hole is located in a sheath 1100 engaging an outer surface of an elongated container 1130 of the sample bottle 1110. Thus, the capability of the elongated container 1130, and of the sample bottle 1110 as a whole, to hold high pressure fluid samples may not be compromised by the presence of the hole in the sample bottle 1110. The roll pin also engages the body 1120 at opposing sides of the cavity 1124, thereby maintaining the sample bottle in contact with the surface of the cavity. While one roll pin 1150 is shown in FIG. 11, a plurality of roll pins may be provided, for example spread along the length of the elongated container 1130. The roll pin 1150 is coupled to the outer surface 1122 of the body to enable the roll pin 1150 to be easily accessed when inserting the sample bottle 1110 into and or removing the sample bottle 1110 from the cavity 1124.

In another example, the braces include a mesh portion, such as the mesh 1250 shown in FIG. 12. The mesh 1250 is coupled to the outer surface 1220 of the sampling tool at opposing sides of the cavity 1224 with a plurality of screws 1252. The mesh 1250 is to engage an outer surface of the sample chamber 1210. Thus, the mesh 1250 may contribute to securing the sample bottle 1210 inside the cavity 1226 by covering at least a portion of the opening 1226. The mesh 1250 may be easily removed from the opening 1226 during servicing of the sample bottle 1210.

In yet another example, the braces include one or more clamps, such as clamps 1350 shown in FIG. 13. The clamps 1350 are coupled to the outer surface 1322 of the body 1320 at opposing sides of the cavity 1324. For example, one side of a clamp may be coupled to the body 1320 via a spindle 1352, while the other side of the clamp 1350 may be coupled to the body 1320 via a screw 1354. The clamps 1350 may include saddle clamps. The clamps 1350 are to engage an outer surface of the sample chamber 1310. The clamps 1350 may be easily removed from the opening 1326 during servicing of the sample bottle 1210.

The example braces of FIGS. 11, 12 and 13 may be combined. For example, a bracing system may include meshes interleaved with clamps or roll pins. As the openings 1126, 1226 and 1326 may be partially exposed to the wellbore in which the sampling tool is positioned, it may be useful to utilize sample bottles having an inner elongated cylinder protected with an outer sheath, as described herein. For example, the cylinder may be made of nickel alloy and the sheath may be made of polymer, among other material combinations.

As apparent in FIGS. 11, 12 and 13, the opening 1126, 1226 and 1326 and the braces are to provide access to the sample bottles 1110, 1210 and 1310, even when all or at least some of the braces are coupled to the tool bodies 1120, 1220 and 1320. Therefore, a human operator may positively secure a fluid sample in the bottles 1110, 1210 and 1310 by accessing and actuating a manual valve of the sample bottle prior to disengaging the braces 1150, 1250 or 1350. Also, the human operator may vent pressure trapped in sampling tool flowline by accessing and opening a vent plug of the sample bottle prior to disengaging the braces 1150, 1250 or 1350. Thus, the braces 1150, 1250 or 1350 may provide protection against high pressure hazard during servicing of the sample bottles in a case where the vent plugs are accessible while the bottles 1110, 1210 and 1310 are secured by the braces 1150, 1250 and 1350, respectively.

Figure 14:
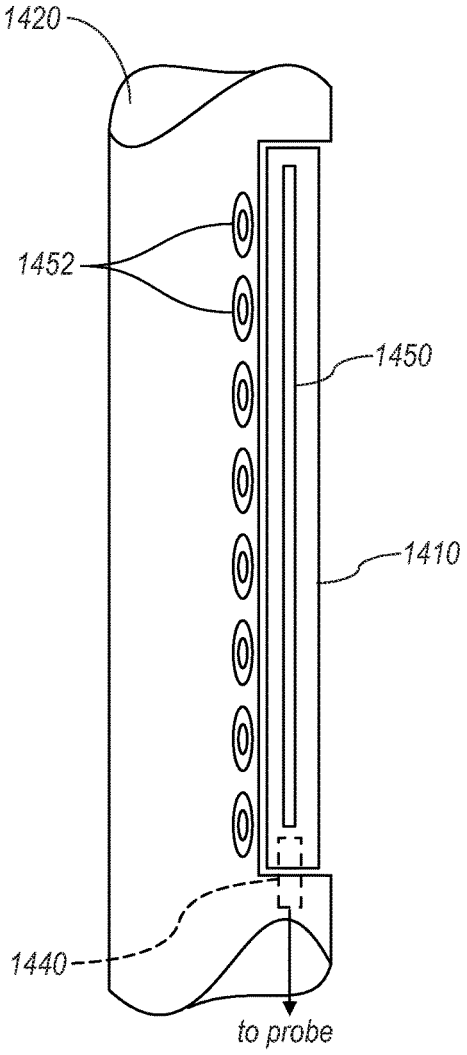
Figure 15:
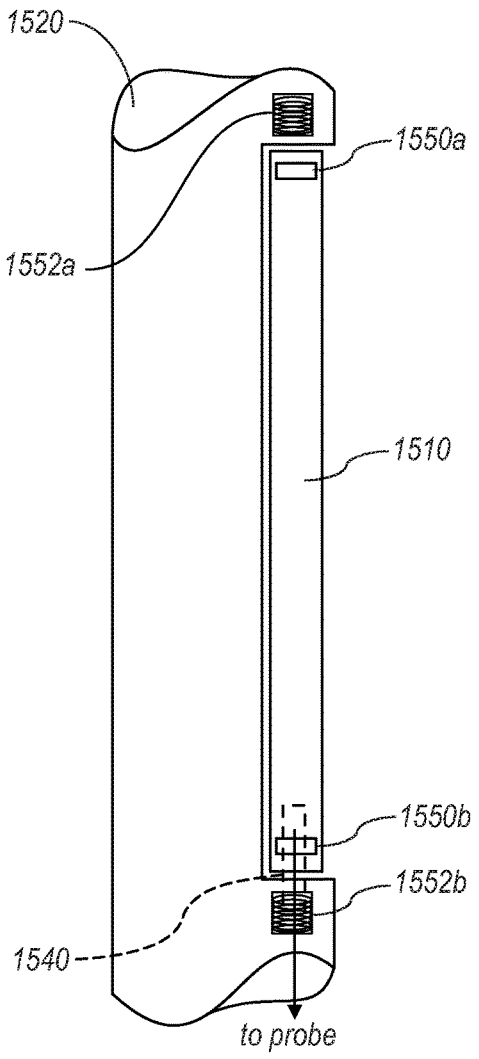

FIGS. 14 and 15 are schematic views of portions of example sampling tools according to one or more aspects of the present disclosure. Similar to FIG. 2, the sampling tools comprise one or more fluid communication devices (e.g., probes) to extend from the sampling tools and to establish fluid communication with a subterranean formation penetrated by a wellbore in which any of the sampling tools are positioned.

Each sampling tool comprises a body 1420 or 1520 (e.g., a collar, a mandrel holder, a housing) having an outer surface. The outer surface comprises an opening, extending into a cavity in the body. The sampling tools also comprise sample bottles 1410 and 1510 positioned in the cavities and to receive and retain fluid samples extracted from a subterranean formation. For example, the sample bottles 1410 and 1510 may be in selective fluid communication with the subterranean formation via flowlines 1440 and 1540, respectively. In some cases, the sampling tools may also include a passage (not shown) to conduct drilling mud.

The sample bottles 1410 and 1510 include elongated containers (not shown separately) to receive the fluid sample. The sample bottles also include magnets 1450, 1550*a* and/or 1550*b* mechanically coupled to the elongated container. For example, the magnets 1450, 1550*a* and/or 1550*b* may be embedded into a polymeric sheath or sleeve surrounding the elongated containers. The magnet (or series of magnets) 1450 may be positioned on a side of the sample bottle 1410 between the ends of the elongated container. The magnets 1550*a* and 1550*b* are positioned at the end of the elongated container.

The sampling tools also include magnets 1452, 1552*a*, and/or 1552*b* disposed proximate to the cavities and to attract the magnets 1450, 1550*a* and/or 1550*b*, respectively. For example, the pairs of magnets 1450 and 1452, 1550*a* and 1552*a*, and 1550*b* and 1552*b* are adjacent, and the polarities of the magnet pairs are arranged to provide attractive coupling. Thus, the sample bottle 1410 may be laterally secured within its cavity, and/or the sample bottle 1510 may be axially secured within its cavity. Alternatively, the configurations of FIGS. 14 and 15 may be combined.

The magnets 1450, 1550*a* and/or 1550*b* may be made of magnetic material. The magnets 1452, 1552*a*, and/or 1552*b* may be electro-magnets or may be made of permanent magnetic material.

When a plurality of electro-magnets 1452 is used, the electromagnets may be used to sense a position of a sliding piston disposed within the elongated container of the sample bottle 1410, for example using the Hall Effect.

Figure 16:
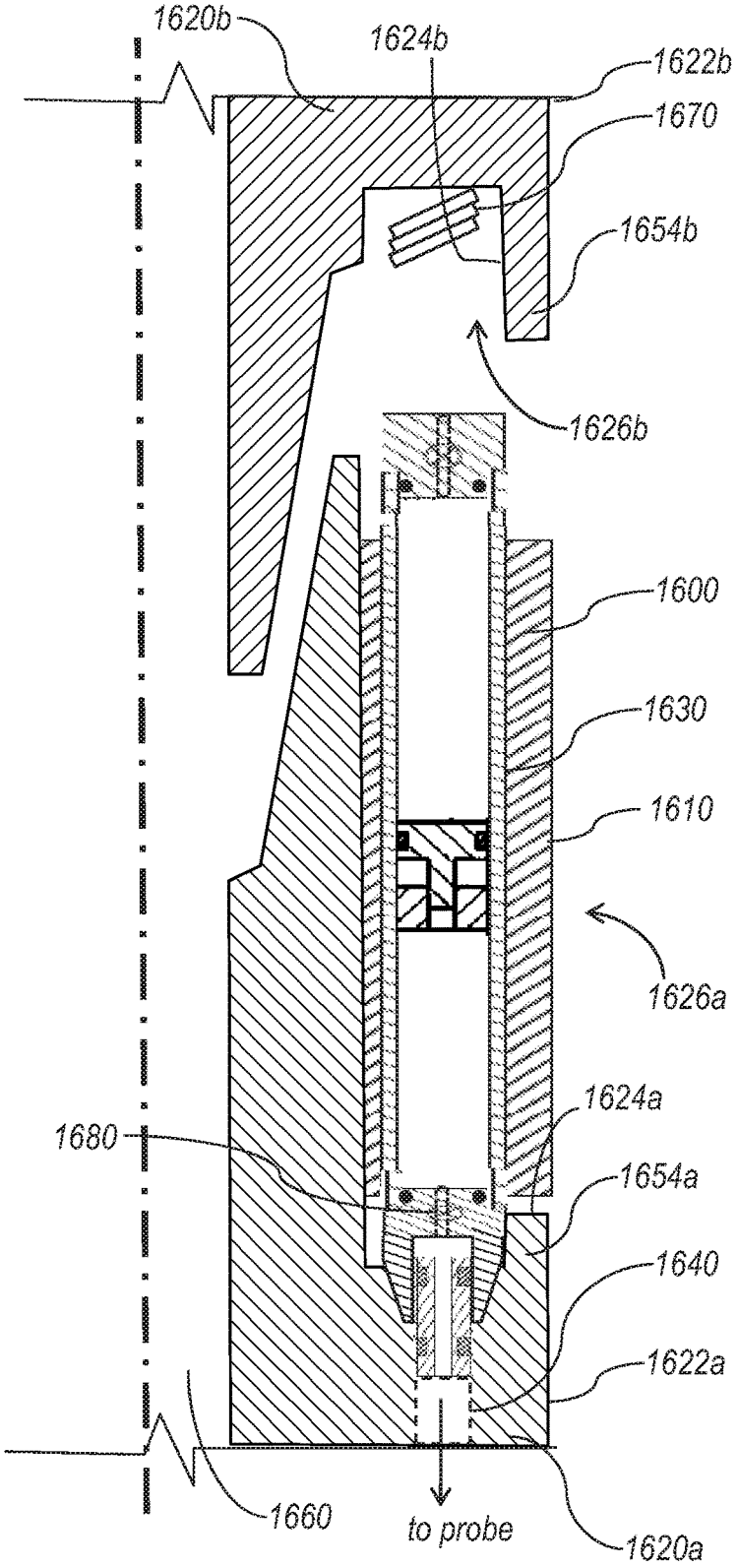

FIG. 16 is a schematic view of a portion of an example sampling tool according to one or more aspects of the present disclosure. Similar to FIG. 2, the sampling tool comprises a fluid communication device (e.g., a probe) to extend from the sampling tool and establish fluid communication with a subterranean formation penetrated by a wellbore in which the sampling tool is positioned.

The sampling tool comprises a body (e.g., a collar, a mandrel holder, a housing) comprising two parts 1620*a* and 1620*b* to releasably couple and decouple. For example, the parts 1620*a* and 1620*b* may include box and pin portions of a threaded connection. When coupled, the parts 1620*a* and 1620*b* cooperate to form a passage to conduct drilling mud, for example as shown with the passage 1660.

The part 1620*a* defines an outer surface 1622*a* having an opening 1626*a* extending into at least one cavity 1624*a* in the part 1620*a* of the body of the sampling tool. While only one cavity is depicted in FIG. 16, the sampling tool may include a plurality of cylindrical cavities arranged around the perimeter of the body part 1620*a* similar to the examples shown in FIGS. 12 and 13. The cavity 1624*a* may receive a sample bottle 1610 coupled within the cavity 1624*a* and in selectable fluid communication with the formation via a flowline 1640 and the fluid communication device.

The part 1620*b* defines an outer surface 1622*b* having an opening 1626*b* extending into a cavity 1624*b* in the part 1620*b* of the body of the sampling tool. The opening 1626*b* is positioned to register with the sample bottle 1610 upon coupling of the parts 1620*a* and 1620*b*. The cavity 1624*b* is shaped to permit threading of parts 1620*a* and 1620*b* when the sample bottle 1610 is located within the cavity 1624*a*. For example, the cavity 1624*b* may be a substantially annular cavity. The cavity 1624*b* is sized to receive a loading assembly 1670. The loading assembly may include an annular spring stack and thrust bearings. The loading assembly may be used to compress the sample bottle 1610 when the parts 1620*a* and 1620*b* are coupled.

The parts 1620*a* and 1620*b* comprise protuberances 1654*a* and 1654*b* extending from the outer surfaces 1622*a* and 1622*b*, respectively. The protuberances 1654*a* and 1654*b* are to engage the sample bottle 1610 upon coupling of part 1620*a* and 1620*b*. Thus, the sample bottle 1610 may be radially secured within the cavities 1624*a* and 1624*b*. For example, the protuberances 1654*a* and/or 1564*b* may comprise a web spanning over the openings 1626*a* and 1626*b*, respectively. Alternatively, the protuberances 1654*a* and/or 1654*b* may comprise a boss extending partially over the openings the openings 1626*a* and 1626*b*, respectively. The protuberances 1654*a* and/or 1654*b* may be integral to the parts 1620*a* and 1620*b* of the body of the sampling tool. The protuberances 1654*a* and 1654*b* may assist in securing the sample bottle 1610 within the cavities 1624*a* and 1624*b*. Since the sample bottle 1610 may be exposed to the wellbore in which the sampling tool is lowered, the sample bottle 1610 may comprise an inner container 1630 and an outer sheath 1600. For example, the inner container 1630 may include a metallic cylinder and the outer sheath 1600 may include a polymeric sleeve, among other material combinations.

Thus, upon coupling the parts 1620*a* and 1620*b* at the Earth's surface, the sample bottle 1610 is incorporated to the downhole sampling tool. After the downhole sampling tool is utilized to obtain samples of formation fluids and retrieved to the Earth's surface, the fluid sample retained in the sample bottle 1610 is positively sealed within the sample bottle 1610, for example by manually closing a shut-in valve 1680. As shown, the opening 1626*a* and the protuberance 1654*a* are to leave access to a portion of the sample bottle 1610, such as access to the valve 1680. Additionally, access to a vent plug (not shown) may be provided. Parts 1620*a* and 1620*b* are decoupled and the sample bottle 1610 may then be detached or removed from the downhole sampling tool.

Figure 17:
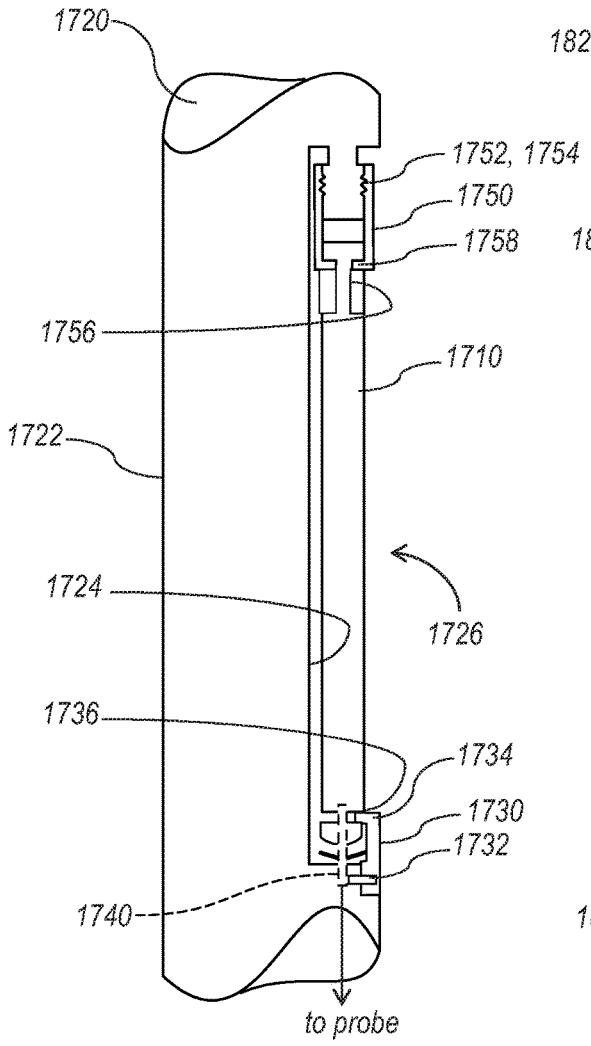
Figure 18:
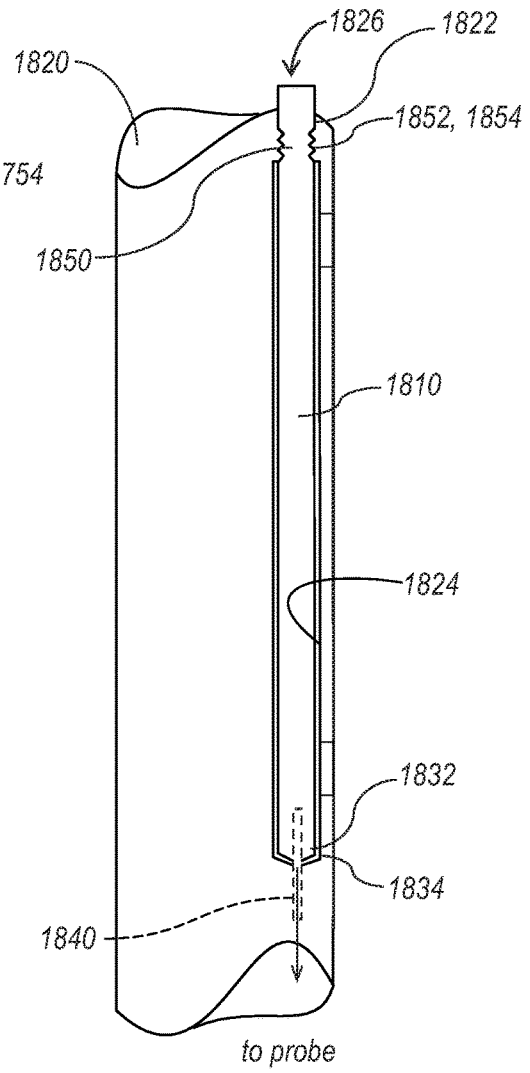
Figure 19A:
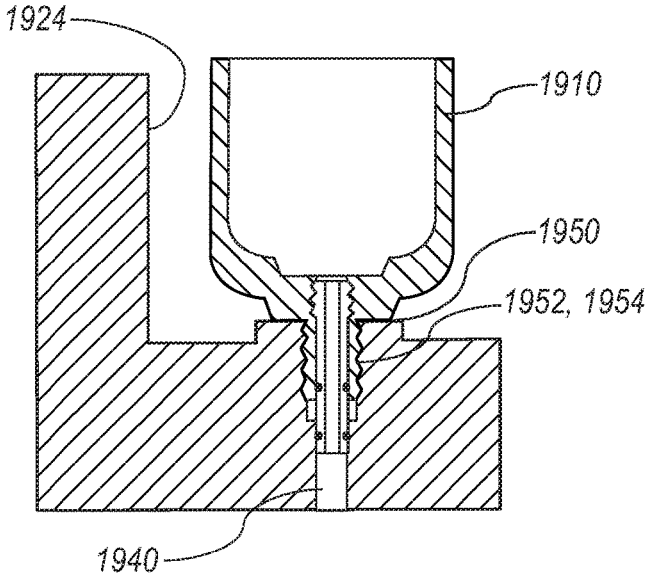
Figure 19:
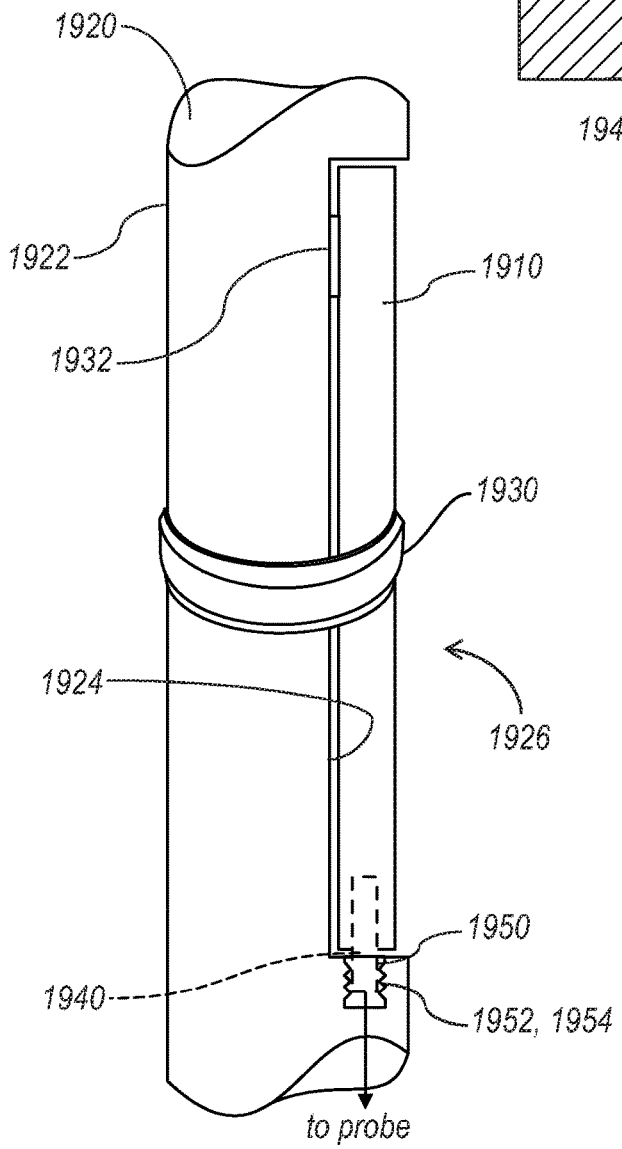

FIGS. 17, 18 and 19 are schematic views of portions of example sampling tools according to one or more aspects of the present disclosure. Similar to FIG. 2, the sampling tools comprise one or more fluid communication devices (e.g., probes) to extend from the sampling tools and to establish fluid communication with a subterranean formation penetrated by a wellbore in which any of the sampling tools are positioned.

Each sampling tool comprises a body 1720, 1820 or 1920 (e.g., a collar, a mandrel holder, a housing) having an outer surface 1722, 1822, or 1922, respectively. The outer surfaces 1722, 1822, or 1922 comprise openings 1726, 1826 and 1926, extending into cavities 1724, 1824 and 1924 in the bodies 1720, 1820 and 1920, respectively. The sampling tools also comprise sample bottles 1710, 1810 and 1910 positioned in the cavities 1724, 1824 and 1924, and to receive and retain fluid samples extracted from a subterranean formation. For example, the sample bottles 1710, 1810 and 1910 may be in selective fluid communication with the subterranean formation via flowlines 1740, 1840 and 1940, respectively. In some cases, the sampling tools may also include a passage (not shown) to conduct drilling mud.

Each cavity 1724, 1824 and 1924 comprises a threaded surface 1754, 1854, and 1954, respectively. Each sample bottle 1710, 1810 and 1910 comprises an elongated container to receive a fluid sample (not shown separately), and a retainer coupled to the container, respectively retainers 1750, 1850 and 1950. Each retainer 1750, 1850 and 1950 comprises a threaded surface 1752, 1852, and 1952, respectively. Each threaded surface of the retainer is to engage the corresponding threaded surface of the cavity 1754, 1854, and 1954, respectively. Thus, the retainers 1750, 1850 and 1950 may contribute to securing each of the sample bottles 1710, 1810 and 1910 within its corresponding cavity, respectively cavities 1724, 1824 and 1924.

For example, the retainer of the sample bottle 1710 comprises a turn-buckle style nut 1750 having a threaded surface 1752. The retainer is coupled to one end of the sample bottle 1710 via a tongue 1758. The tongue 1758 is coupled to the turn-buckle style nut 1750 and to engage a groove 1756 located on an outer surface of the sample bottle 1710. As shown, the turn-buckle style nut 1750 may be used to hold the sample bottle 1710 in tension within the cavity 1724. For example, once the sample bottle 1710 is positioned in the cavity 1724 through the aperture 1726, a hook 1730 is secured to the body 1720 of the sampling tool via a pin, key or screw 1732. The hook 1730 further comprises a hook tongue 1734 that is inserted into a hook groove 1736 of the sample bottle 1710. The retainer 1750 is then threaded to the body 1720 of the sampling tool, until sufficient tension is applied to the sample bottle 1710. The tension applied to the sample bottle 1710 may permit securing the sample bottle 1710 even when the temperature of the sample bottle 1710 increases to temperature levels encountered in wellbores, and the temperature level causes the sample bottle 1710 to expand thermally. The tension applied to the sample bottle 1710 may also permit securing the sample bottle 1710 even when the sample bottle 1710 retain a highly pressurized fluid sample and the pressure level causes the sample bottle 1710 to extend elastically. However, the configuration of FIG. 17 may be modified to have the retainer 1750 hold the sample bottle 1710 in compression within the cavity 1724.

In another example, the retainer of the sample bottle 1810 comprises the screw 1850 having the threaded surface 1852. The screw 1850 is integral to the sample bottle 1810 and has an outer diameter larger than an outer diameter of the sample bottle 1810. As shown, the sample bottle 1810 may be inserted vertically into the cylindrical cavity 1824. The screw 1850 is then threaded to the body 1820 of the sampling tool. An opposite end 1832 of the sample bottle 1810 abuts a receiving surface 1834 of the cavity 1824. Threading may continue until sufficient compression is applied to the sample bottle 1810 to permit securing the sample bottle 1810 in the cavity 1824.

In yet another example, the retainer of the sample bottle 1910 comprises a threaded nose 1950, a sectional view of which is shown in FIG. 19A. The nose 1950 has a substantially cylindrical shape. The nose 1950 comprises a passage to receive a stabber. The stabber provides fluid communication between the elongated container of the sample bottle 1910 and the flowline 1940. The sample bottle 1910 is inserted into the cavity 1924 through the opening 1926, and is threaded to the body 1920 of the sampling tool. An anti-rotation device 1932 is used to maintain the threaded connection between the sample bottle 1910 and the body 1920 during operation of the sampling tool. Also, a ring 1930 may be provided to further assist in securing the sample bottle 1910 within the cavity 1924, for example similar to the description of FIG. 10. Also, the sample bottle 1910 may include an outer polymeric sheath. An outer surface of the sheath may engage an inner surface of the cavity 1924, for example similar to the description of FIG. 4.

Figure 20:
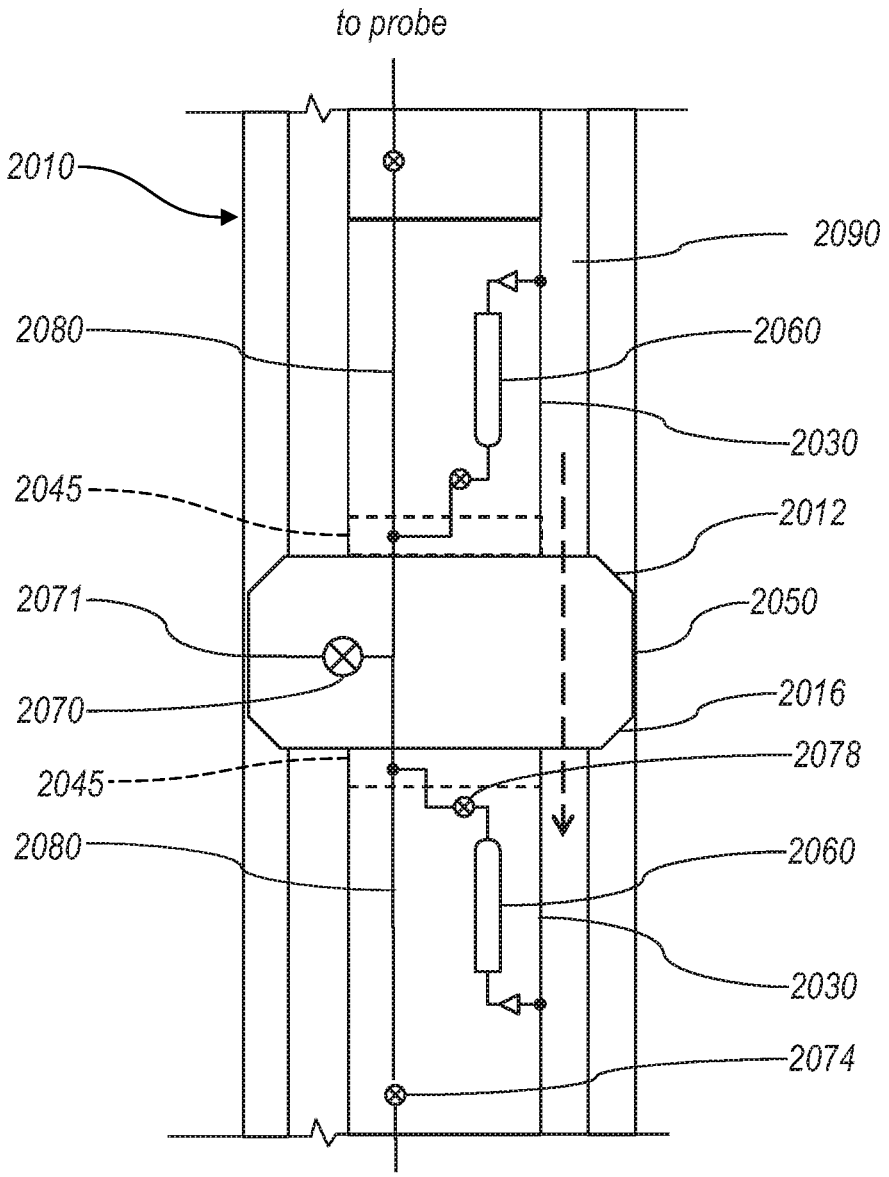

FIG. 20 is a schematic view of a portion of an example sampling tool according to one or more aspects of the present disclosure. Similar to FIG. 2, the sampling tool comprises one or more fluid communication devices (e.g., probes) to extend from the sampling tool and to establish fluid communication with a subterranean formation penetrated by a wellbore in which any of the sampling tool is positioned.

The sampling tool may be included in a drill string. For example, the sampling tool comprises collars 2010 having a passage 2090 to conduct drilling mud as illustrated by the arrows. Mandrel holders 2030 are positionable within the collars 2010. The mandrel holders 2030 are to receive at least one sample bottle, such as sample bottles 2060. It is noted that the mandrel holders 2030 may include more than one sample bottle, and that mandrel holders 2030 may include sample bottles of different types. Thus, the mandrel holders 2030 may permit incorporation of a variable number of sample bottles to the downhole sampling tool. For example, the mandrel holders 2030 may comprise a manifold 2045 to provide selective fluid communication between each one of the plurality of sample bottles 2060 and the formation.

The mandrel holders 2030 include at least one connecting end that is to be releasably coupled to a connection sub 2050. The connection sub 2050 is coupled to the collar 2010 via threaded connectors 2012 and 2016. The passage 2090 extends through the connection sub 2050, as indicated by the arrows, thereby permitting the conduction of drilling mud across the sampling tool.

During connection, fluid and/or electrical communication are established between the mandrel holders 2030 and the connection sub 2050. Thus, after connection between the mandrel holders 2030 and the connection sub 2050, the sample bottles 2060 are in selectable fluid communication with the formation via the fluid communication device. For example, the connection sub 2050 and the mandrel holders 2030 comprise portions of a flowline 2080. The flowline 2080 is in selectable fluid communication with the formation via the fluid communication device.

The connection sub 2050 includes a valve 2070 to control flow of formation fluid between the flowline 2080 and an exit port 2071. As shown, the exit port 2071 fluidly communicates with the wellbore in which the sampling tool is disposed. However the exit port 2071 may fluidly communicate with the passage 2090. The valve 2070 may be passive, such as provided with a check valve, a relief valve, or may be actively (electrically or hydraulically) driven.

The valve 2070 of the connection sub 2050 may permit sampling operation sometimes referred to as low shock sampling. During a low shock sampling operation, fluid is pumped from formations penetrated by the wellbore in which the sampling tool is positioned, and conveyed through the flowline 2080. An isolation valve 2074 is closed, and the pumped fluid escapes the flowline 2080 at the exit port 2071. When a fluid sample is to be captured, one of the sample valves 2078 associated with one on the sample bottles 2060 is opened. Once the sample bottle 2060 is full, the pumped fluid may still escape the flowline 2080 at the exit port 2071. The one of the sample valves 2078 is closed to capture a fluid sample in the one sample bottle 2060.

Figure 21:
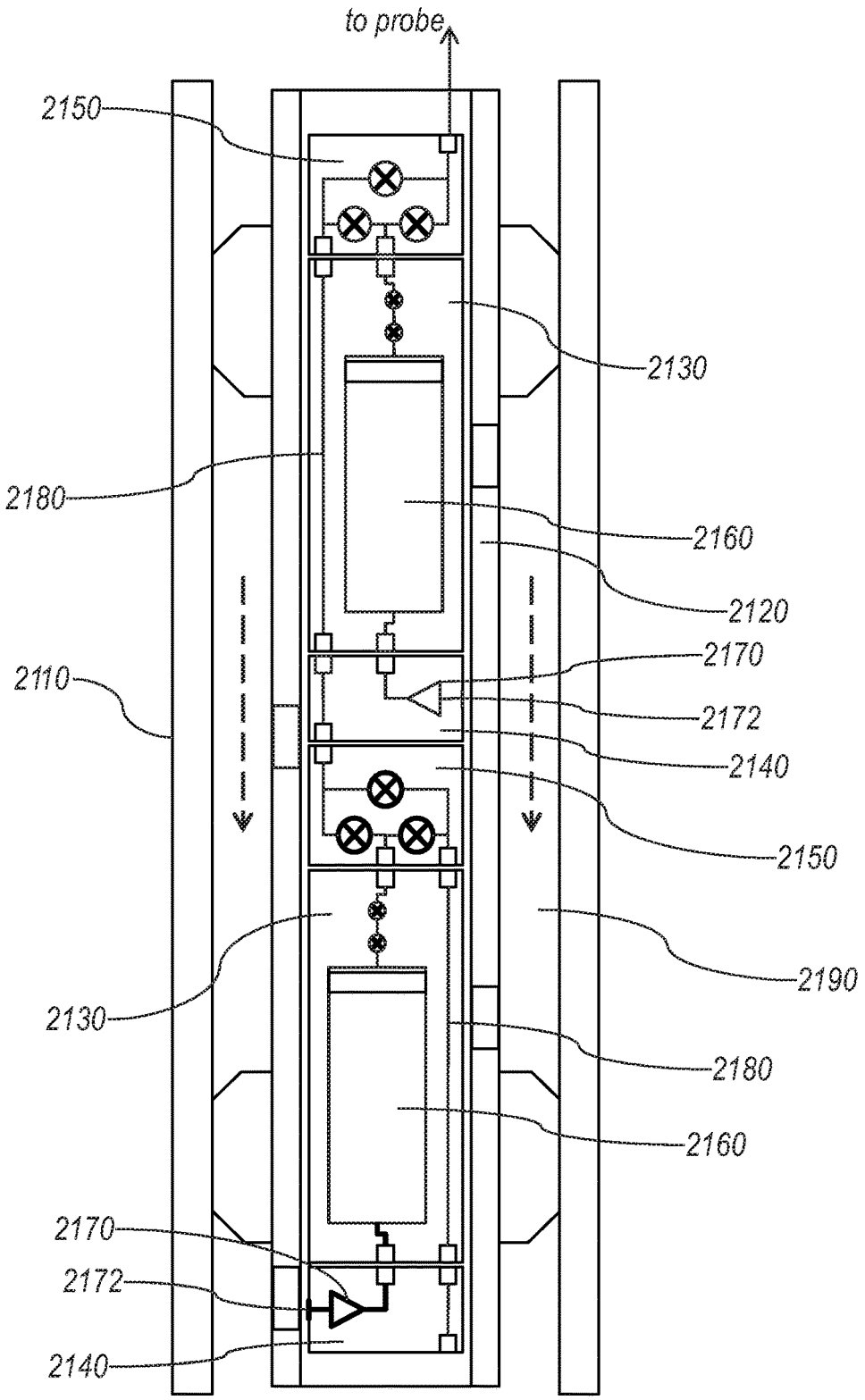
Figure 22:
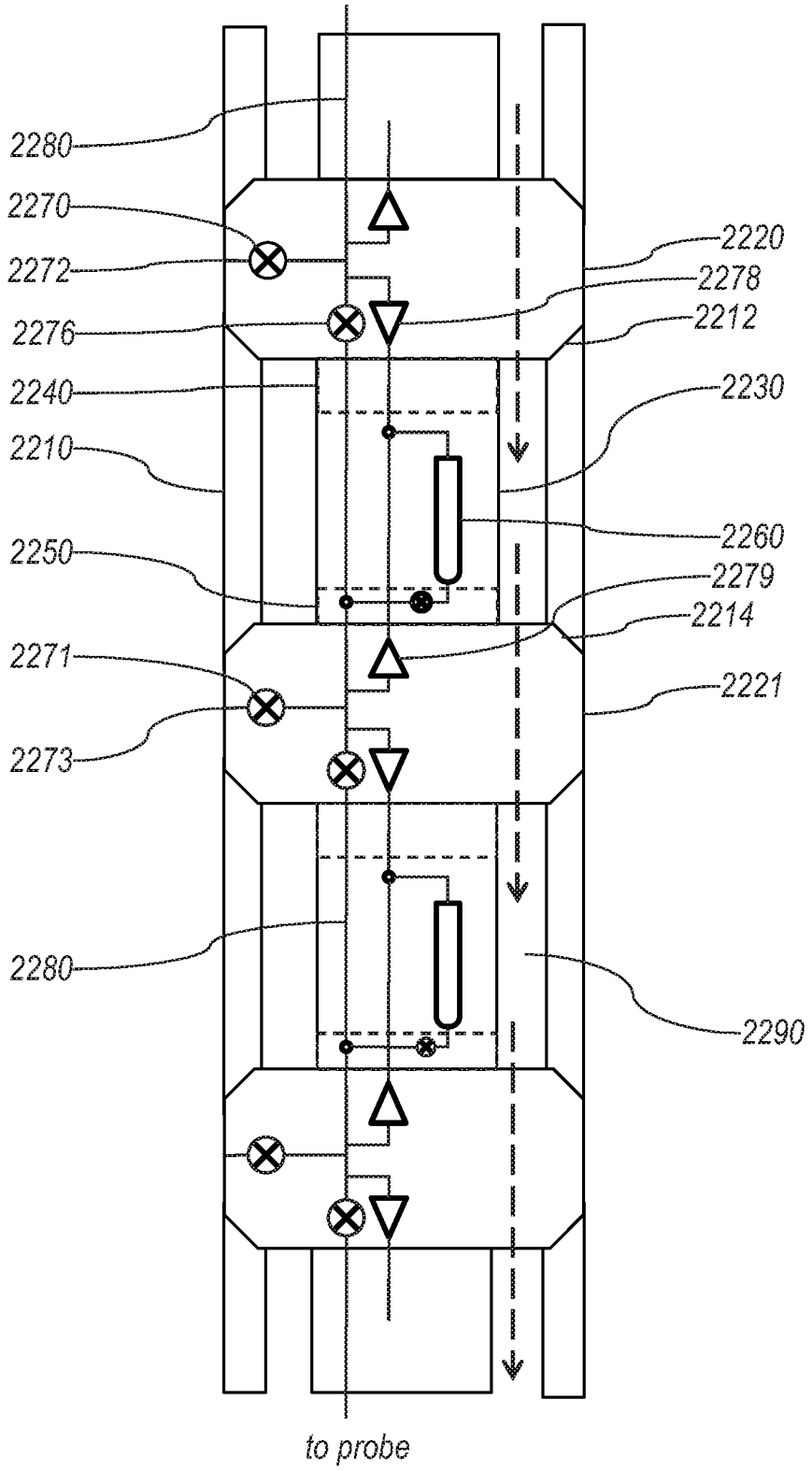

FIGS. 21 and 22 are schematic views of portions of example sampling tools according to one or more aspects of the present disclosure. Similar to FIG. 2, the sampling tools comprise one or more fluid communication devices (e.g., probes) to extend from the sampling tools and to establish fluid communication with a subterranean formation penetrated by a wellbore in which any of the sampling tools are positioned.

The sampling tools comprise collars 2110 or 2210 having a passage, respectively 2190 or 2290, to conduct drilling mud, as illustrated by the arrows. Mandrel holders 2130 and 2230 are positionable within the collar 2110 and 2210, respectively. The mandrel holders 2130 and 2230 are to receive at least one sample bottle, such as sample bottle 2160 or 2260. It is noted that the mandrel holders 2130 and 2230 may include more than one sample bottle, and that the mandrel holders 2130 and 2230 may includes sample bottles of different types.

As shown, the mandrel holders 2130 and 2230 have upper and lower connecting ends. Each of the upper and lower connecting ends is to be releasably coupled to a connection sub. For example, the upper connecting end of the mandrel holder 2130 is to be coupled to the connection sub 2150. The lower connecting end of the mandrel holder 2130 is to be coupled to the connection sub 2140. Similarly, the upper connecting end of the mandrel holder 2230 is to be coupled to the connection sub 2220, and the lower connecting end of the mandrel holder 2230 is to be coupled to the connection sub 2221. The assembly of mandrel holders and connection subs in FIGS. 21 and 22 may permit incorporation of a variable number of sample bottles to a downhole sampling tool to be included in a drill string.

For example, a particular housing 2120 and collar 2110 having an appropriate length to incorporate the number of sample bottles may be selected. As shown in FIG. 21, the mandrel holders 2130, including the samples bottles 2160, may be stacked in the selected housing 2120, interleaved between connection subs 2140 and 2150. Upon coupling between the mandrel holders 2130, the connection subs 2140 and the connection subs 2150, fluid and/or electrical communication are established between the mandrel holders 2130, the connection subs 2140 and the connection subs 2150. Additional termination subs may be coupled to the stack. For example, the termination subs may include portions of connectors such as described in U.S. Pat. No. 7,367,394, loading devices to secure the plurality of connection subs and mandrel holders, among other components. The selected housing 2120 is then inserted into the selected collar 2110. The housing and collar assembly is then coupled to the drill string.

In another example, the connection sub 2220 is to couple with an upper end 2212 of the collar 2210. The connection sub 2221 is to couple with a lower end 2214 of the collar 2210. For example, the connection subs 2220 and 2221 may comprise a male threaded connector to engage a corresponding female threaded connector on the collar 2210. Thus, pairs of mandrel holders and collars, such as the mandrel holder 2230 and the collar 2210, may be interconnected between connection subs, such as the connections subs 2220 and 2221. After connection, the passage 2290 extends through the connection subs 2220 and 2221, thereby permitting the conduction of drilling mud across the sampling tool. Also, fluid and/or electrical communication are established between the mandrel holders 2230 and the connection subs 2220 and 2221. As shown in FIG. 22, additional collar and mandrel holder pairs may be interleaved between connection subs, thereby extending the number of sample bottles incorporated into the assembly.

Once incorporated, the sample bottles 2160 and 2260 may be in selectable fluid communication with the formation via the fluid communication device provided with the sampling tool. For example, a flowline 2180 fluidly coupled to the fluid communication device runs through connection subs 2140 and 2150 as well as through the mandrel holders 2130. The samples bottles 2160 are selectively fluidly coupled to the flowline 2180. Similarly, a flowline 2280 fluidly coupled to the fluid communication device runs through the connection subs 2220 and 2221 as well as through the mandrel holder 2230. The sample bottle 2260 is selectively fluidly coupled to the flowline 2280.

The connection subs 2140, 2150, 2220 and 2221 comprise a valve block comprising at least one valve. As shown, valves 2170, 2270 and 2271 are to control flow between the sampling tool and at least one of the wellbore and the passage to conduct drilling mud. The connection subs 2140 comprise the valves 2170 fluidly coupled between the passage 2190 and the flowline 2180 via ports 2172 and apertures in the housing 2120. The connection subs 2220 and 2221 include the valves 2270 and 2271 fluidly coupled between the flowline 2280 and ports 2272 and 2273, respectively. The valves may be passive, such as check valves 2170, or actively driven, such as the valves 2270 and 2271. While some valves are shown as part of a connection sub, such valves may alternatively be provided in a mandrel holder. For example, isolation valve 2276, and check valves 2278 and 2279 may alternatively be positioned in a valve block (not shown) of the mandrel holder 2230.

Those skilled in the art and given the benefit of the present disclosure will appreciate that the valves 2170 and 2270 permit a low shock sampling operation. However, the sampling apparatus of the present disclosure, such as the sampling tool in FIG. 22, permit other types of sampling operations, for example reverse low shock sampling operations.

Figure 23:
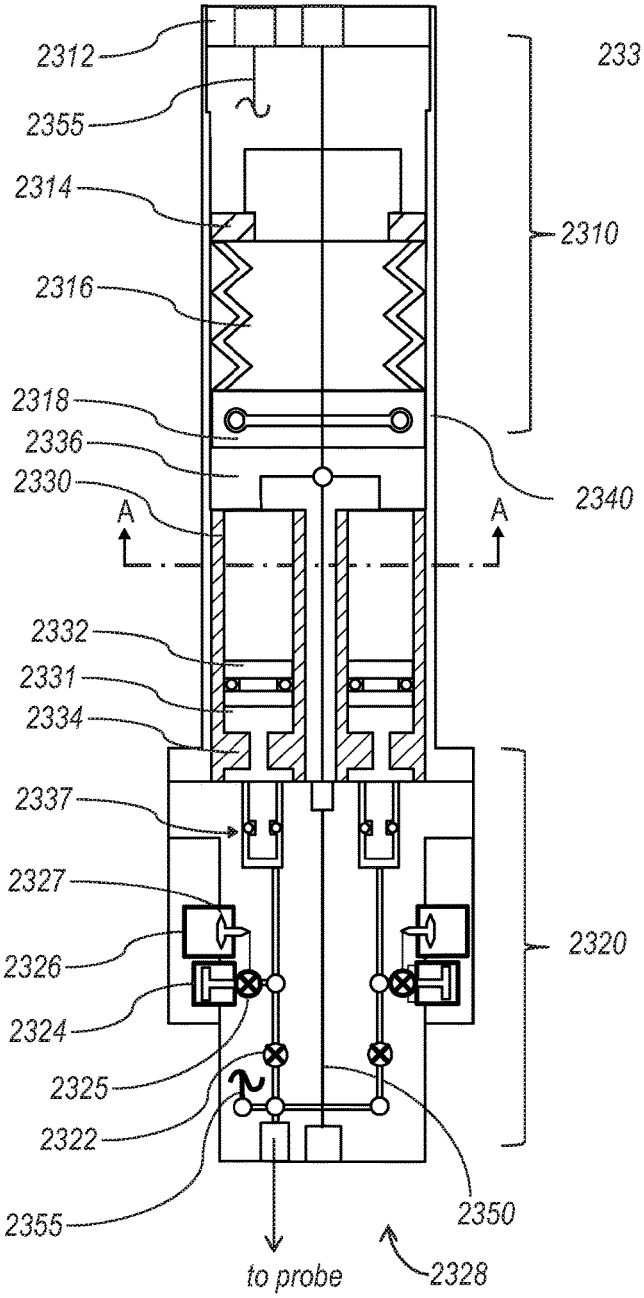
Figure 23A:
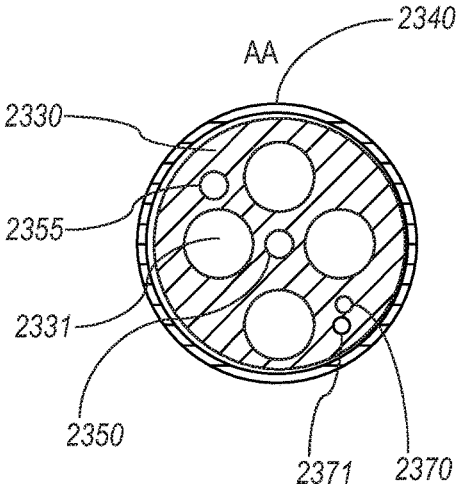

FIG. 23 is a schematic view of an example mandrel holder according to one or more aspects of the present disclosure. The mandrel holder is positionable within a collar (not shown) of a downhole sampling tool. FIG. 23A is a sectional view of the mandrel holder shown in FIG. 23.

The mandrel holder comprises a first connecting end 2318 and a second connecting end 2328. Each of the connecting ends 2318 and 2328 is to couple to a connection sub, for example one or more of the connection subs described or contemplated by the present disclosure. For example, after coupling, a flowline 2355 of the mandrel holder is in selectable fluid communication with the formation via a fluid communication device of the downhole sampling tool. A flowline 2350 of the mandrel holder is in selectable fluid communication with an exit port of the sampling tool, for example a port fluidly coupled to at least one of a wellbore in which the sampling tool is positioned and a passage of the sampling tool to conduct drilling mud. In addition, the mandrel holder may comprise at least one of a hydraulic line 2370 or an electrical line 2371. During coupling, fluid and/or electrical communication may be established between the hydraulic line 2370 and a pressure source (not shown) of the downhole sampling tool and between the electrical wire 2371 and an electrical power source (not shown) of the downhole sampling tool. Thus, hydraulic and/or electric power may be supplied to the mandrel holder, for example to actuate active valves provided therewith.

The mandrel holder is to receive at least one sample bottle 2330. The sample bottle 2330 includes a sliding piston 2332 defining a variable volume chamber 2331. The variable volume chamber 2331 is to receive and retain samples of formation fluid. The sample chamber 2331 includes an agitator 2334. For example, the agitator 1334 may include magnetic material and may be actuated with a magnet positioned outside of the chamber 2331.

The mandrel holder comprises an axial loading device 2310 that may be coupled to a connection sub (not shown) at the connecting end 2318. For example, the axial loading device 2310 may be used to implement portion 2240 shown in FIG. 22. The axial loading device 2310 comprises a cap 2312. The cap 2312 is to compress a spring stack 2316 between a loading block 2314 and a thrust ring 2318 upon insertion, for example threading, into a housing 2340 of the mandrel holder. The housing 2340 may be a pressure tied housing. The axial loading device 2310 contributes to securing the sample bottle 2330 in the mandrel holder. The thrust ring 2318 assists in decoupling the rotation of the cap 2312 from the sample bottle 2330.

As shown, the mandrel holder may receive a plurality of sample bottles. The mandrel holder may comprise a first manifold 2336 fluidly coupled to the sample bottle and a second manifold 2320 to provide selectable fluid communication between each one of the plurality of sample bottles and the flowline 2355. For example, each sample bottle 2330 be may coupled to a corresponding valve 2322 disposed in the second manifold 2320. The second manifold 2320 may be coupled to a connection sub (not shown) at the connecting end 2328. For example, the second manifold 2320 may be used to implement portion 2250 in FIG. 22.

The sample bottle 2330 is removable from the mandrel holder. For example, the cap 2312 may be decoupled, for example unthreaded, from the housing 2340, releasing the manifold 2336. The sample bottle 2330 may then be removed from within the housing 2340. The sample bottle 2330 is provided with a self-closing valve 2337. Thus, a fluid sample in the sample bottle 2330 may be positively sealed upon detaching or removing the sample bottle 2330 from the manifold 2320.

The second manifold 2320 includes a sample port 2326 closed by a plug 2327. When open, the sample port 2326 may be used to drain the sample bottle 2330 or to make measurements on the fluid located between the sample chamber 2331 and valve 2322. Fluid communication between the sample port 2326 and the sample chamber 2331 is further controlled by a manual valve 2325 located in a cavity 2324. Access to both the plug 2327 and the manual valve 2325 may be provided through the collar of the downhole sampling tool.

Figure 24A:
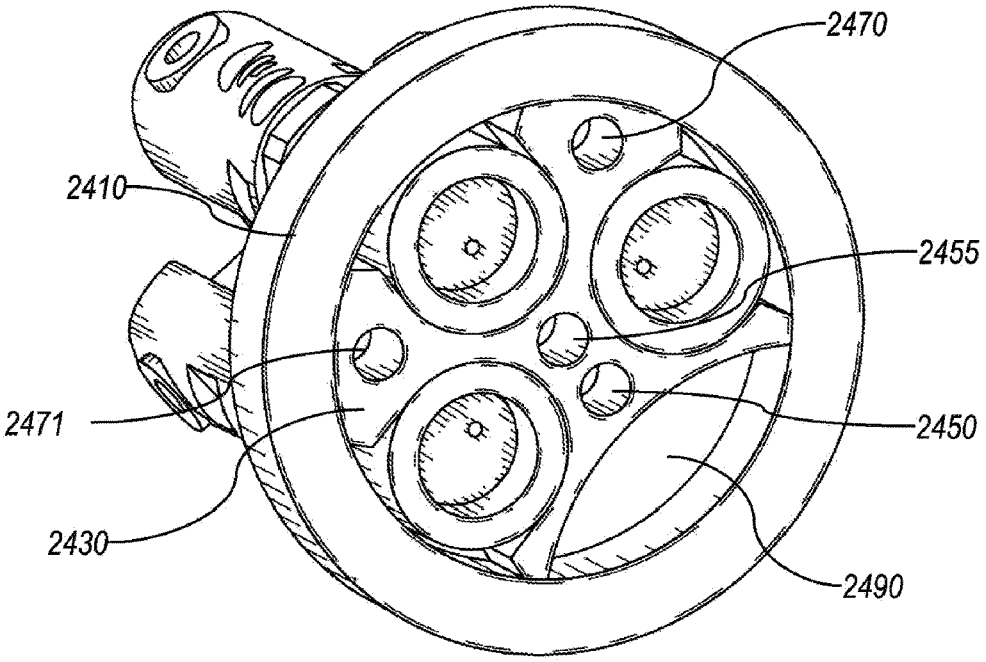
Figure 24B:
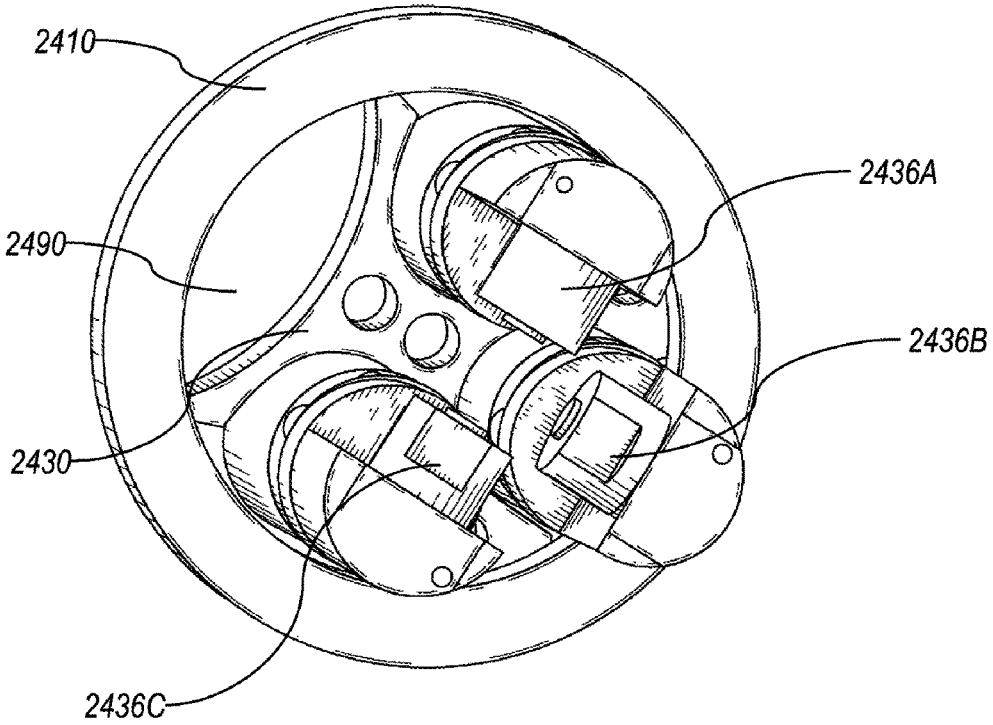

FIGS. 24A and 24B are schematic views of a portion of an example sampling tool according to one or more aspects of the present disclosure. The downhole sampling tool comprises a collar 2410. The collar 2410 comprising a passage 2490 to conduct drilling mud.

The downhole sampling tool comprises a mandrel holder. The mandrel holder comprises a frame 2430. The frame 2430 is to support multiple sample bottles 2436A, 2436B and/or 2436C. The frame 2430 is also to allow passage of fluid extracted from the formation, for example via a flowline 2455, and/or fluid expelled from one of the sample bottles 2436A, 2436B and/or 2436C via a flowline 2450. The frame 2430 may further be used to pass hydraulic flowline(s) 2470 and power, signal, and communication wire(s) 2471.

In operation, the frame 2430 is flooded with drilling mud conducted in the passage 2490. Thus, the number of required pressure bearing barriers is reduced. Also, the space available for disposing the sample bottles 2436A, 2436B and/or 2436C in the collar 2410 is increased. Further, an outer surface of the frame 2430 comprises a scalloped cutout to allow high flow of the drilling mud through the downhole sampling tool.

Figure 25:
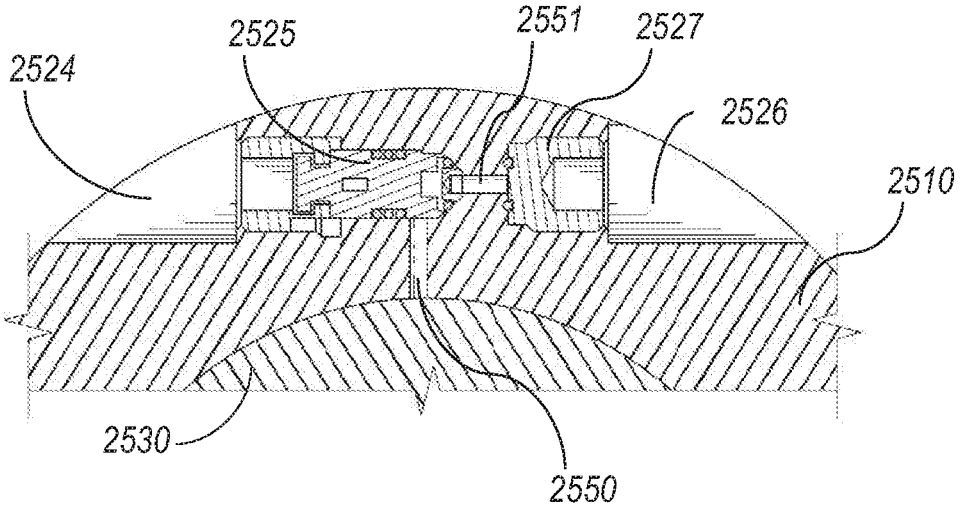
Figure 26:
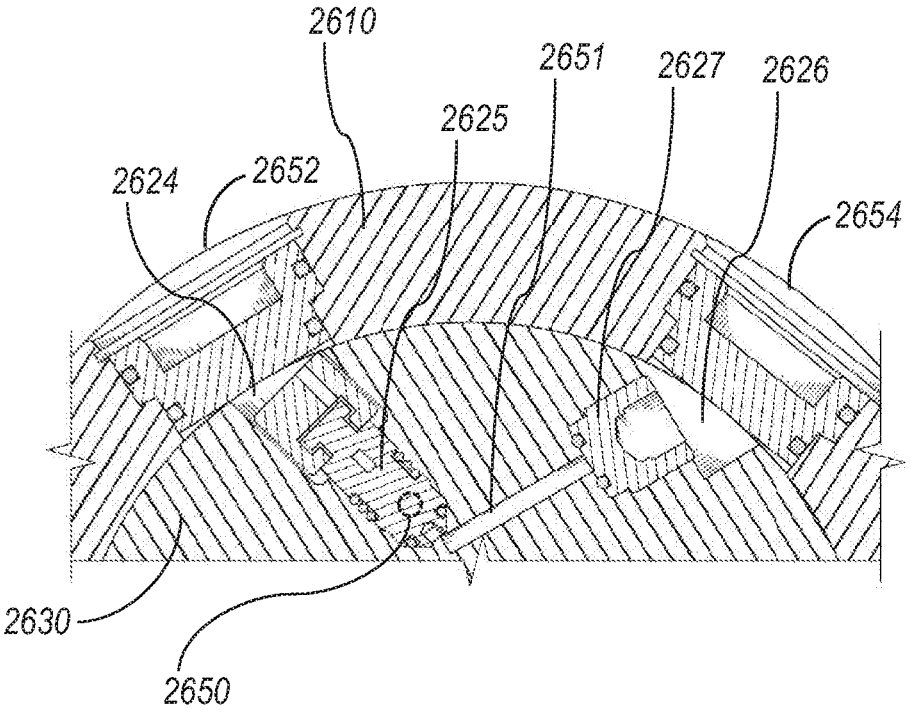

FIGS. 25 and 26 are schematic views of portions of example sampling tools according to one or more aspects of the present disclosure. The downhole sampling tools comprise collars 2510 and 2610. The collars 2510 and 2610 may comprise a passage (not shown) to conduct drilling mud. The downhole sampling tools also comprise mandrel holders and/or sample bottles 2530 and 2630.

The mandrel holders and/or sample bottles 2530 and 2630 comprise flowlines 2550 and 2650, respectively. For example, the flowlines 2550 and 2650 may be fluidly couple to a container or chamber in which a sample of formation fluid is retained. The mandrel holders and/or sample bottles 2530 and 2630 comprise flowlines 2551 and 2651, respectively. Manual valves 2525 and 2625 are fluidly coupled between the flowlines 2550 and 2650, and the flowlines 2551 and 2651, respectively. The mandrel holders and/or sample bottles 2530 and 2630 also comprise plugs 2527 and 2627. For example, the plugs 2527 and 2627 cover ports of the flowlines 2551 and 2651, respectively.

The sampling tools provide access to the manual valves 2525 and 2625 through the collars 2510 and 2610 via access ports 2524 and 2624, respectively. For example, each access port 2524 or 2624 comprises an aperture extending into a cavity, wherein the cavity registers with the corresponding manual valve 2525 or 2625. The access so provided may allow, for example, a human operator to positively seal fluid samples retained inside the containers or chambers of the downhole sampling tools as soon as the sampling tools are retrieved to the Earth's surface. Then, the mandrel holders and/or the sample bottles 2530 and 2630 may safely be removed from the sampling tool.

The sampling tools also provide access to the manual plugs 2527 and 2627 through the collars 2510 and 2610 via access ports 2526 and 2626, respectively. For example, each access port 2526 or 2626 comprises an aperture extending into a cavity, wherein the cavity registers with the corresponding plug 2527 or 2627. The access so provided may allow, for example, a human operator to transfer fluid samples retained inside the containers or chambers of the downhole sampling tools to another portable container.

As shown in FIG. 26, the access ports 2624 and 2626 may be covered with respective removable plugs 2652 and 2654.

Figure 27B:
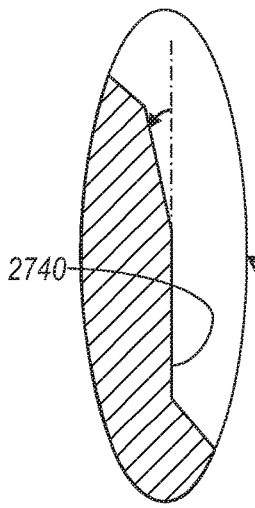
Figure 27:
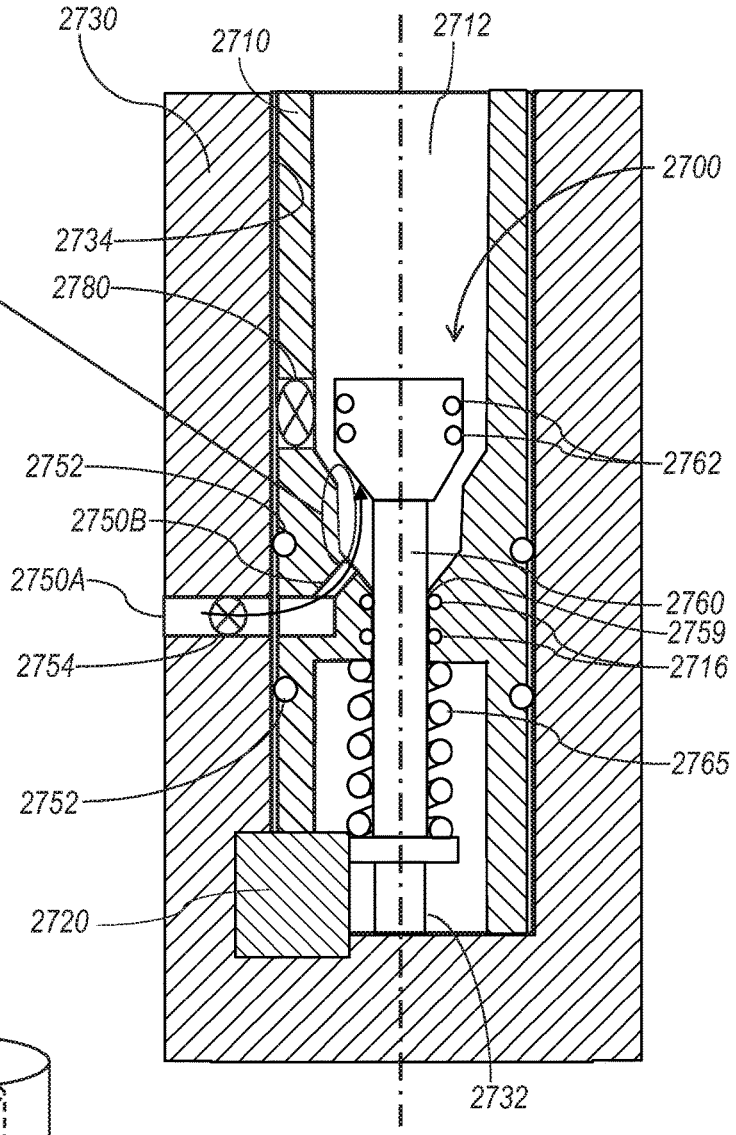
Figure 27A:
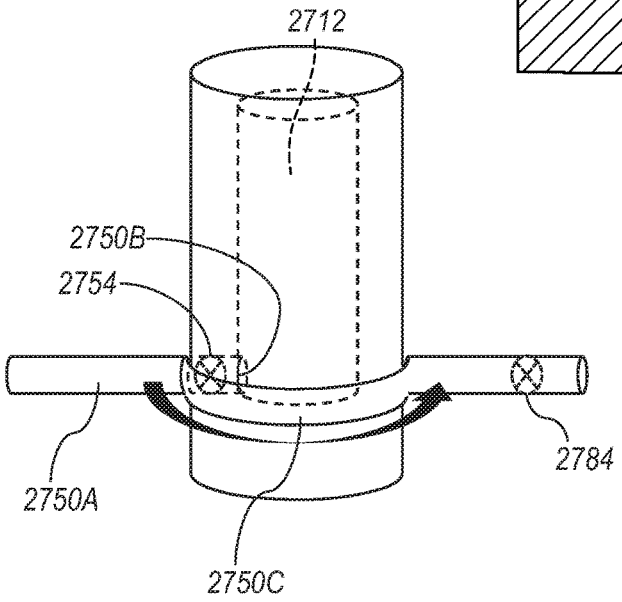

FIGS. 27, 27A and 27B are schematic views of a portion of an example sample bottle according to one or more aspects of the present disclosure. The sample bottle 2710 comprises an elongated container 2712 to receive a fluid sample. The sample bottle 2710 also comprises a valve 2700 to control flow of the fluid sample in/out of the elongated container 2712. The valve 2700 may automatically open when the sample bottle 2710 is introduced into a downhole sampling tool. The valve 2700 may also automatically close when the sample bottle 2710 is removed from the sampling tool. Therefore, the valve 2700 may alleviate having to manually access the sample bottle 2710 before removing the sample bottle 2710 from the downhole sampling tool, for example.

The downhole sampling tool may comprise a collar having a passage to conduct drilling mud, and the sample bottle 2710 may be positioned at least partially within the passage, such as shown in FIGS. 22 and 23. The downhole sampling tool includes a body 2730 (e.g., a collar, a mandrel holder, a housing). A cavity 2734 extends into the body 2730. The cavity 2734 is to receive at least partially the sample bottle 2710. For example, the cavity 2734 may include a blind cylindrical recess, and the sample bottle 2710 may include a cylindrical end sized to fit in the cavity 2734. A key 2720 may be provided to insure proper alignment between the sample bottle 2710 and the cavity 2734.

A flowline having portions 2750A, and 2750C is fluidly coupled to a fluid communication device (e.g., a probe). The fluid communication device is to extend from the downhole sampling tool and establish fluid communication with a subterranean formation penetrated by a wellbore in which the downhole sampling tool is positioned. A valve 2754 is to control flow of fluid between the flowline portion 2750A and the elongated container 2712 is initially closed. A valve 2784 to control flow of fluid through the flowline portion 2750C is initially open. Thus, formation fluid may flow through the flowline portions 2750A and 2750C in a direction indicated by the arrow in FIG. 27A. To capture a sample of formation fluid in the elongated container 2712, the valve 2754 may be opened and the valve 2784 may be closed. Thus, formation fluid may flow through a flowline portion 2750B and into the elongated container 2712 in a direction indicated by the arrow in FIG. 27.

The sample bottle 2710 includes O-rings 2752 on two sides of an inlet of the flowline 2750B. The O-rings 2752 are positioned on an outer surface of the sample bottle 2710 such that the O-rings 2752 provide a sealed fluid communication between the inlet of the flowline 2750B and the flowline portion 2750A after the sample bottle 2710 is inserted into the cavity 2734, for example when it abuts a blind end of the cavity 2734.

The end of the sample bottle 2710 includes a through hole 2759. A rod 2760 is provided across the through hole and is to slide within the through hole 2759. O-rings 2716 are provided between the rod 2760 and the sample bottle 2710 to seal the elongated container 2712. The blind end of the cavity 2734 includes an actuator 2732, such as a protuberance. The actuator 2732 is to actuate the rod 2760 of the sample bottle 2710 as the sample bottle 2710 is introduced into and/or removed from the cavity 2734. For example, the rod 2760 is to engage the actuator 2732 when the bottle 2710 is inserted into the cavity 2734, and to actuate (to open) the valve 2700.

The actuator 2732, the rod 2760, the cavity 2734 and the sample bottle 2710 are sized such that the actuator 2732 engages the rod 2760 after the O-rings 2752 provide a sealed communication between the flowline portion 2750A and the inlet of the flowline 2750B. The actuator 2732, the rod 2760, the cavity 2734 and the sample bottle 2710 are sized such that the actuator 2732 disengages the rod 2760 before the sealed communication between the flowline portion 2750A and the inlet of the flowline 2750B provided by the O-rings 2752 is broken. Thus, the sealed communication between the flowline portion 2750A and the inlet of the flowline 2750B is maintained while the valve 2700 is opening or closing.

The valve 2700 comprises an enlarged end portion of the rod 2760. The enlarged end portion comprises O-rings 2762. The enlarged portion of the rod 2760 includes a cylindrical surface sized to fit into a profile 2740 shown enlarged in FIG. 27B. For example, the profile 2740 may include a first tapered portion against which the enlarged end portion of the rod 2760 may abut when the valve 2700 is closed. The profile 2740 may include a cylindrical portion against which the O-rings 2762 may seal. The profile 2740 may include another slightly tapered portion to progressively compress the O-rings 2762 as the valve 2700 closes. The valve 2700 is normally closed or self-sealing. For example, the valve 2700 may comprise a spring 2765 that biases the rod 2760 against the flowline 2750B.

In use, the sample bottle 2710 is inserted into the cavity 2734 of the downhole sampling tool when the downhole sampling tool is at the Earth's surface. As apparent from the foregoing, a sealed fluid communication between the flowline portion 2750A and the inlet of flowline portion 2750B is established with the O-rings 2752. The rod 2760 engages the actuator 2732 and slides with respect to the sample bottle 2710, thereby opening the valve 2700. The downhole sampling tool may be lowered into a wellbore. A sample of formation fluid may be received into the sample bottle 2710. The downhole sampling tool may be retrieved to the Earth's surface. As the sample bottle 2710 is removed from the downhole sampling tool, first the rod 2760 slides with respect to the sample bottle 2710, thus closing the valve 2700 as the O-rings 2762 engage the profile 2740. Then, the rod 2760 disengages the actuator 2732. Finally, the sealed fluid communication between the flowline portion 2750A and the inlet of flowline portion 2750B is broken. The valve 2700 thus seals a formation fluid sample in the sample bottle 2710. A transport cap (not shown) may then be screwed on top of the sample bottle 2710 and may be sized to cover the O-rings 2752. The sample may be accessed via a drain port 2780.

In view of the above and FIGS. 1 to 27, it should be readily apparent to those skilled in the art that the present disclosure provides an apparatus comprising a fluid communication device to extend from a sampling tool and establish fluid communication with a subterranean formation penetrated by a wellbore in which the sampling tool is positioned, wherein the sampling tool comprises an opening extending into a cavity, a sample bottle coupled within the cavity and in selectable fluid communication with the formation via the fluid communication device, and a member to secure the sample bottle within the cavity. The member may comprise a protuberance extending from the outer surface of the sampling tool and to engage the sample bottle. The member may comprise a brace removably coupled to the outer surface of the sampling tool at opposing sides of the cavity. The member may comprise a ring to engage a perimeter of the sampling tool and an outer surface of the sample bottle.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, a sample bottle coupled within the cavity and in selectable fluid communication with the formation via the fluid communication device, and a protuberance extending from the outer surface of the sampling tool and to engage the sample bottle, whereby the sample bottle is secured within the cavity. The protuberance may comprise a web spanning over the opening. The protuberance may comprise a boss extending partially over the opening. The opening into the cavity and the protuberance may be to provide access to a portion of the sample bottle. The protuberance may be an integral part of a sampling tool housing. The sample bottle may comprise an inner metallic container and an outer polymeric sheath. The sampling tool may comprise a first body having a first portion of the cavity extending therein, and a second body having a second portion of the cavity extending therein, and the first and second bodies may be releasably coupled.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, a sample bottle coupled within the cavity and in selectable fluid communication with the formation via the fluid communication device, and a brace removably coupled to the outer surface of the sampling tool at opposing sides of the cavity, whereby the sample bottle is secured within the cavity. The brace may comprise a clamp. The clamp may be a saddle clamp. Alternatively or additionally, the brace may comprise a roll pin or a mesh. The opening into the cavity and the brace may provide access to an outer surface of the sample bottle. The brace may engage an outer surface of the sample bottle. The sample bottle may comprise an inner metallic container and an outer polymeric sheath.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending a cavity, a sample bottle coupled within the cavity and in selectable fluid communication with the formation via the fluid communication device, and a ring to engage a perimeter of the sampling tool and an outer surface of the sample bottle, whereby the sample bottle is secured within the cavity. The ring may comprise a wear band positionable over at least a portion of the cavity. The ring may comprise a drill string stabilizer positionable over at least a portion of the cavity. The opening into the cavity and the ring may provide access to a component of the sample bottle. The sample bottle may comprise an inner metallic container and an outer polymeric sheath.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, and a sample bottle to be positioned into the cavity and in selectable fluid communication with the formation via the fluid communication device. The sample bottle comprises an elongated container to receive a fluid sample, and a sheath engaging an outer surface of the elongated container and to couple to the cavity, whereby the sample bottle is secured within the cavity. The sheath may comprise a cylindrical blind cap. The sheath may comprise a polymeric material. The polymeric material may comprise at least one of polyether ether-ketone, polyether ketone, fluorocarbon polymer, nitrile butadiene rubber, or epoxy resin portions. The sheath may comprise flanges to secure the sample bottle to the sampling tool. The apparatus may further comprise a cover to be positioned over at least a portion of the opening. The cover may be affixed to the sheath. The sheath may comprise a wedge-shaped cross section to slide into a dovetail section of the cavity. The apparatus may further comprise at least one of a roll pin and a screw to secure the sheath to the sampling tool. The sheath may be removably coupled to the container via a jam-nut. The sheath may comprise a boss to engage a recess of the cavity.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, and wherein the cavity comprises a first threaded surface; and a sample bottle to be positioned into the cavity and in selectable fluid communication with the formation via the fluid communication device. The sample bottle comprises an elongated container to receive a fluid sample, and a retainer coupled to the elongated container and having a second threaded surface to engage the first threaded surface whereby the sample bottle is secured within the cavity. The sample bottle may comprise an outer polymeric sheath coupled to an outer surface of the elongated container. An outer surface of the sheath may engage an inner surface of the cavity. The retainer may comprise a cylindrical nose coupled to an end of the elongated container. The nose may comprise a passageway for the fluid sample. The retainer may comprise a nut coupled to an end of the sample bottle. The retainer may comprise a tongue coupled to the nut and to engage a groove located on an outer surface of the sample bottle. The retainer may comprise a screw. The screw may have an outer diameter larger than an outer diameter of the sample bottle.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, and a sample bottle to be positioned into the cavity and in selectable fluid communication with the formation via the fluid communication device. The sample bottle comprises an elongated container to receive a fluid sample, and a first magnet coupled to the elongated container. The apparatus further comprises a second magnet disposed proximate to the cavity and to attract the first magnet whereby the sample bottle is secured within the cavity. The first magnet may be positioned at an end of the elongated container. The second magnet may comprise a plurality of electro-magnets. The plurality of electromagnets may sense a position of a sliding piston disposed within the elongated container.

The present disclosure also provides an apparatus comprising, a fluid communication device to extend from a sampling tool and establish fluid communication with a subterranean formation penetrated by a wellbore in which the sampling tool is positioned, wherein the sampling tool comprises an opening extending into a cavity, and a sample bottle to be positioned into the cavity and in selectable fluid communication with the formation via the fluid communication device. The sample bottle comprises an elongated container to receive a fluid sample, and a valve to control flow of the fluid sample out of the elongated container. The apparatus further comprises an actuator coupled to the sampling tool and to open the valve upon positioning of the sample bottle into the cavity. The apparatus may further comprise a collar having a passage to conduct drilling mud, and the sample bottle may be positioned at least partially within the passage. The valve may be a normally closed valve.

The present disclosure also provides an apparatus comprising, a fluid communication device to extend from a drill string and establish fluid communication with a subterranean formation penetrated by a wellbore in which the drill string is positioned, a collar comprising a passage to conduct drilling mud, a mandrel holder positionable within the collar and to receive at least one sample bottle, the mandrel holder having first and second connecting ends, and first and second connection subs, wherein the first connection sub is to couple to the first connecting end of the mandrel holder, and wherein the second connection sub is to couple to the second connecting end of the mandrel holder, whereby the at least one sample bottle is incorporated into the drill string and is in selectable fluid communication with the formation via the fluid communication device. The passage to conduct drilling mud may extend through each of the first and second connection subs. At least one of the first and second connection subs may comprise a flowline in selectable fluid communication with the formation via the fluid communication device. The at least one of the first and second connection subs may comprise a valve to control flow of formation fluid between the flowline and at least one of the wellbore and the passage. The mandrel holder may comprise a flowline in selectable fluid communication with the formation via the fluid communication device. The mandrel holder may comprise a pressure tied housing. The mandrel holder, the first and the second connection subs may be stacked along a housing. The mandrel holder may receive a plurality of sample bottles, and may comprise a manifold to provide fluid communication between each one of the plurality of sample bottles and the formation. The mandrel holder may comprise at least one of a hydraulic line fluidly coupled to a pressure source and an electrical line coupled to an electrical power source. The mandrel holder may comprise a loading device to the at least one sample bottle. The loading device may comprise a thrust ring and a plurality of springs to engage the at least one sample bottle. The at least one sample bottle may comprise a manual valve, the collar may comprise an aperture extending into a cavity, and the cavity may register with the manual valve. The apparatus may further comprise a plug to cover the aperture. The at least one sample bottle may comprise an elongated container to receive a fluid sample, and a normally closed valve to control flow of the fluid sample out of the elongated container. The mandrel holder may comprise an actuator to open the normally closed valve upon positioning of the at least one sample bottle into the mandrel holder. The at least one sample bottle may be removable from the mandrel holder. The first and second connection subs may couple with first and second ends of the collar, respectively. Each of the first and second connection subs may comprise a male threaded connector to engage a corresponding female threaded connector on the collar.

The present disclosure also provides an apparatus comprising, a fluid communication device to extend from a drill string and establish fluid communication with a subterranean formation penetrated by a wellbore in which the drill string is positioned, a collar comprising a passage to conduct drilling mud, a connection sub comprising a flowline in selectable fluid communication with the formation via the fluid communication device, the connecting sub having first and second connecting ends; and first and second mandrel holders positionable within the collar and each to receive at least one sample bottle, wherein the first mandrel holder is to couple to the first connecting end of the connecting sub, and wherein the second mandrel holder is to couple to the second connecting end of the connecting, whereby at least two sample bottles are incorporated into the drill string and are in selectable fluid communication with the formation via the fluid communication device. The passage to conduct drilling mud may extend through the connection sub. The connection sub may comprise a valve to control flow of formation fluid between the flowline and at least one of the wellbore and the passage. At least one of the first and second mandrel holders may comprise a flowline in selectable fluid communication with the formation via the fluid communication device. At least one of the first and second mandrel holders may comprise a pressure tied housing. At least one of the first and second mandrel holders may receive a plurality of sample bottles, and may comprise a manifold to provide fluid communication between each one of the plurality of sample bottles and the formation. Each of the at least two sample bottles may comprise a manual valve, the collar may comprise an aperture extending into a cavity, and the cavity may register with the manual valve. The apparatus may further comprise a plug to cover the aperture. Each of the at least two sample bottles may comprise an elongated container to receive a fluid sample, and a normally closed valve to control flow of the fluid sample out of the elongated container. The mandrel holder may comprise an actuator to open the normally closed valve upon positioning of the at least one sample bottle into the mandrel holder. Each of the at least two sample bottles may be removable from the first and second mandrel holders. The connection sub may couple with the collar. The connection sub may comprise a male threaded connector to engage a corresponding female threaded connector on the collar. At least one of the first and second mandrel holders may comprise a loading device. The loading device may comprise a thrust ring and a plurality of springs to engage the at least one sample bottle. At least one of the first and second mandrel holders may comprise at least one of a hydraulic line fluidly coupled to a pressure source and an electrical line coupled to an electrical power source.

Although only a few example embodiments have been described in detail above, those skilled in the art will readily appreciate that many modifications are possible in the example embodiments without materially departing from this disclosure. Accordingly, such modifications are intended to be included within the scope of this disclosure as defined in the following claims. In the claims, means-plus-function clauses are intended to cover the structures described herein as performing the recited function and not only as structural equivalents, but also equivalent structures. Thus, although a nail and a screw may be not structural equivalents in that a nail employs a cylindrical surface to secured wooden parts together, whereas a screw employs a helical surface, in the environment of fastening wooden parts, a nail and a screw may be equivalent structures. It is the express intent of the applicant not to invoke 35 U.S.C. § 112, paragraph 6 for any limitations of any of the claims herein, except for those in which the claim expressly uses the words "means for" together with an associated function.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims.

What is claimed is:

1. An apparatus, comprising:

a downhole tool having a body including an opening and a cavity extending into the body from the opening; and a sample container comprising:

an elongated container for holding a formation fluid sample, wherein the elongated container comprises an annular wall defining a chamber configured to receive fluids; and a sheath coupled to at least a portion of an outer surface of the annular wall of the elongated container such that the sheath abuts the portion of the outer surface along a length of the annular wall and at least partially surrounds the elongated container, wherein the sample container is fixed in the cavity and the sheath is configured to increase the mechanical integrity of the elongated container in a downhole environment.

2. The apparatus of claim 1 wherein the sample container is fixed in the cavity via a pin extending through the sheath and into the body of the downhole tool.

3. The apparatus of claim 1 wherein the sample container is fixed in the cavity via a clamp extending across the opening.

4. The apparatus of claim 1 wherein the sample container is fixed in the cavity via a mesh extending across the opening.

5. The apparatus of claim 1 wherein the sample container is fixed in the cavity via a ring extending about an outer surface of the body and across the opening.

6. The apparatus of claim 1 wherein the sample container is fixed in the cavity via a dovetail connection between the sheath and a recess in the cavity.

7. The apparatus of claim 1 wherein the sample container is fixed in the cavity via ears of the sheath and fasteners extending through the ears into the body.

8. The apparatus of claim 1 wherein the sample container is fixed in the cavity via an interference fit between the sheath and the cavity.

9. The apparatus of claim 1 wherein the sample container is fixed in the cavity via a spacer or a pneumatic jack between an end of the sample container and the cavity.

10. The apparatus of claim 1 wherein the sample container is fixed in the cavity via a threaded connection comprising threads on a portion of the body adjacent the cavity.

11. The apparatus of claim 10 further comprising:

a nut coupled to a groove at one end of the sample container, the nut configured to couple to the threads, to tension the sample container, and to fix the sample container in the cavity; and a hook at the other end of the sample container configured to fix the other end of the sample container to the body.

12. The apparatus of claim 1 wherein the sheath comprises a layer portion of a first material and a cover portion of a second material overlying the layer portion.

13. The apparatus of claim 1 wherein the sheath is coupled to the outer surface of the elongated container via a molding operation, a press-fit, a slip-fit or a shrink-fit.

14. The apparatus of claim 1 wherein the sheath is coupled to the elongated container via a loading assembly comprising a spring pack and a jam nut.

15. The apparatus of claim 1 further comprising a stabber coupled to the elongated container, the stabber configured to fluidly couple the elongated container to a flowline in the downhole tool when the sample container is fixed in the cavity.

16. The apparatus of claim 1 wherein the body comprises a first body portion threadably coupled to a second body portion, the first and second body portions configured to cooperate to fix the sample container in the cavity formed by at least one of the first or second body portions.

* * * * *